US007517185B2

(12) United States Patent
Hirakawa et al.

(10) Patent No.: US 7,517,185 B2
(45) Date of Patent: Apr. 14, 2009

(54) AIR CONDITIONER

(75) Inventors: Seiji Hirakawa, Tokyo (JP); Shoji Yamada, Tokyo (JP); Akira Takamori, Tokyo (JP); Mitsuhiro Shirota, Tokyo (JP); Toshiaki Yoshikawa, Tokyo (JP); Takashi Ikeda, Tokyo (JP); Hiroki Okazawa, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 413 days.

(21) Appl. No.: 10/585,104

(22) PCT Filed: Sep. 14, 2005

(86) PCT No.: PCT/JP2005/016929

§ 371 (c)(1),
(2), (4) Date: Jun. 30, 2006

(87) PCT Pub. No.: WO2006/038442

PCT Pub. Date: Apr. 13, 2006

(65) Prior Publication Data

US 2008/0181764 A1 Jul. 31, 2008

(30) Foreign Application Priority Data

Oct. 1, 2004 (JP) ..... 2004-290083

(51) Int. Cl.
*F04D 5/00* (2006.01)

(52) U.S. Cl. ..... 415/53.1; 415/119; 415/211.1

(58) Field of Classification Search ..... 415/53.1, 415/53.2, 53.3, 119, 175, 176, 178, 211.1
See application file for complete search history.

(56) References Cited

U.S. PATENT DOCUMENTS 5,197,850 A * 3/1993 Shinobu et al. ..... 415/53.1
6,050,773 A * 4/2000 Bushnell ..... 415/53.1
6,692,223 B2 * 2/2004 Ikeda et al. ..... 415/53.1

FOREIGN PATENT DOCUMENTS

JP 03-111694 A 5/1991

(Continued)

OTHER PUBLICATIONS

Notification of Transmittal of Copies of Translation of the International Preliminary Report on Patentability (Forms PCT/IB/338 and PCT/IB/373) and Written Opinion of the International Searching Authority (PCT/ISA/237).

*Primary Examiner*—Igor Kershteyn
(74) *Attorney, Agent, or Firm*—Buchanan Ingersoll & Rooney PC

(57) ABSTRACT

In an air conditioner, reverse inhalation is prevented while broad band noise and wind sound are reduced. A projection arranged at the leading end of a stabilizer on the downstream side of an air stream flowing along a surface of the stabilizer opposing an impeller and protrudes toward the impeller to define the shortest distance to the impeller. A plurality of grooves or projections are provided on the opposing surface on the upstream side of the projection to disturb the air stream flowing along the opposing surface. The positions of the grooves or the projections are arranged apart in a rotational axis direction. A plurality of convex portions are provided to disturb an air stream flowing along a surface of a casing opposing the impellers. The positions of the convex portions are arranged apart in the rotational axis direction of the impeller.

9 Claims, 20 Drawing Sheets

FOREIGN PATENT DOCUMENTS

| | | | | |
|---|---|---|---|---|
| JP | 05172085 | A | * | 7/1993 |
| JP | 09-170770 | A | | 6/1997 |
| JP | 11-022997 | A | | 1/1999 |
| JP | 11-294376 | | | 10/1999 |
| JP | 2000-205180 | A | | 7/2000 |
| JP | 2004-150789 | A | | 5/2004 |

* cited by examiner

12f: DIMPLE

AIR CONDITIONER

TECHNICAL FIELD

The present invention relates to air conditioners, and more specifically, it relates to an indoor unit having a cross-flow fan.

BACKGROUND ART

A cross-flow fan for use in conventional air conditioners includes a cross-flow impeller having a plurality of fan bodies linked together, and a rear guider and a stabilizer, which are arranged across the impeller for guiding fluid from an inlet toward an outlet. The rear guider is arranged to have an area covering the side peripheral surface of the impeller larger than that of the stabilizer, and the stabilizer is arranged at a position nearer to the side peripheral surface of the impeller than the rear guider. The rear guider is provided with concave portions formed continuously in a direction perpendicular to the fluid flowing direction, thereby reducing an interference sound produced at a gap between the impeller and the rear guider (see Patent Document 1, for example). The concave portions are formed slightly obliquely to the direction perpendicular to the fluid flowing direction.

There is an air conditioner in that the stabilizer with a lingual surface arranged close to the fan is provided with a plurality of projections formed on the lingual surface, each being inclined at a predetermined angle to each of the plurality of vanes of the fan (see Patent Document 2, for example).

There is also a transverse flow blower in that the stabilizer is provided with a plurality of projections formed on an arc-shaped part adjacent to the fan so as to increase and stabilize the eddy current force generated at the arc-shaped part of the stabilizer for improving the blowing performance (see Patent Document 3, for example).

[Patent Document 1]

Japanese Unexamined Patent Application Publication No. 2000-205180 (P03, FIG. 9)

[Patent Document 2]

Japanese Unexamined Patent Application Publication No. 9-170770 (P03, FIG. 2)

[Patent Document 3]

Japanese Unexamined Patent Application Publication No. 11-22997 (P02, FIG. 1)

SUMMARY

When considering the gap between the impeller and a casing or the gap between the impeller and the stabilizer, the narrower the gap, the air flowing through the gap is more stabilized, improving the blowing efficiency in both the gaps; but broad band noise due to the collision of the high-speed air ejected from the impeller on the casing or the stabilizer is increased. Conversely, the broader the gap, the broad band noise is more reduced; but the air flowing through the gap becomes unstable, deteriorating the blowing efficiency and generating the back flow from the outlet toward the inlet due to the air flow separation from the wall of the casing or the stabilizer.

In the structure of the conventional blower having the concave portion formed on the rear guider of the casing, by reducing the gap between the impeller and the rear guider to some extent, the flow stability is maintained while owing to the concave portion, the distance between the impeller and the rear guider is partially increased so as to reduce the interference sound; however, some possibility is left to further reduce the broad band noise. In particular, when the flow stability is to be maintained by reducing the gap between the impeller and the rear guider to some extent, the concave portion comes close to the impeller, so that the draft resistance is increased by the concave portion arranged in a direction substantially perpendicular to the fluid flowing direction, deteriorating the blowing performance.

In the conventional blower in that the projections formed on the stabilizer lingual surface at the leading end in the downstream of the air flow are inclined to a vane, although the noise originated from the stabilizer projections can be reduced, the noise produced by pressure variations of the air flowing over the stabilizer lingual surface at the leading end in the upstream of the air flow cannot be reduced. Since the shortest distance between the impeller and the stabilizer becomes uniform in the direction of the rotational axis due to the inclination of the projection, the cross-flow eddy currents produced in the impeller cannot be stabilized, so that a problem of the reverse inhalation from the outlet toward the inlet arises.

In the blower in that the stabilizer is provided with the projections formed on the arc-shaped part, the blower simply has a plurality of projections, each has been provided in the vicinity of the leading end of the stabilizer lingual surface, so that some possibility is left to further improve the stability of the eddy currents. There is also a problem that the projection extending in the direction of the rotational axis increases the noise.

The present invention has been made in order to solve the problems described above, and it is an object thereof to obtain an air conditioner capable of preventing reverse inhalation from an outlet toward an impeller of the air conditioner, and further capable of reducing broad band noise and wind noise to the utmost.

Means for Solving the Problems

An air conditioner according to the present invention includes an impeller including a cylindrical fan body extending in a rotational axis direction; a casing and a stabilizer which are arranged with the impeller therebetween for guiding a gas from an inlet to an outlet; a projection which is arranged at the leading end on the downstream side of a gas stream flowing along a surface of the stabilizer opposing the impeller and protrudes toward the impeller so as to define the shortest distance to the impeller; and a plurality of concave portions or convex portions which are arranged on the upstream side of the projection so as to disturb the gas stream flowing along the opposing surface, wherein positions of the concave portions or the convex portions are arranged apart in the rotational axis direction of the impeller.

Another air conditioner according to the present invention includes an impeller including a cylindrical fan body extending in a rotational axis direction; a casing and a stabilizer which are arranged with the impeller therebetween for guiding a gas from an inlet to an outlet; and a plurality of projections arranged on a surface of the casing opposing the impeller so as to disturb a gas stream flowing along the opposing surface, wherein positions of the projections are deviated from the rotational axis direction of the impeller.

[Advantages]

In the air conditioner according to the present invention, turbulences are generated in an air stream flowing along a surface of the stabilizer opposing the impeller by arranging the concave-convex portions on the opposing surface, so that the cross-flow eddy is stabilized to prevent deterioration in blowing performance and the reverse inhalation generation. Furthermore, the positions of the concave-convex portions are arranged apart in the rotational axis direction of the impeller, so that the air conditioner capable of reducing noise can be obtained.

Further, turbulences are generated in an air stream flowing along a surface of the casing opposing the impeller by arranging concave-convex portions formed on the opposing surface, so that the eddy formed in the vicinity of a casing volute tongue portion is stabilized to obtain an air conditioner capable of preventing the deterioration in blowing performance and the reverse inhalation generation. Furthermore, by arranging apart positions of the concave-convex portions in the rotational axis direction of the impeller, an air conditioner capable of reducing noise can be obtained.

BEST MODE FOR CARRYING OUT THE INVENTION

First Embodiment

Figure 1:
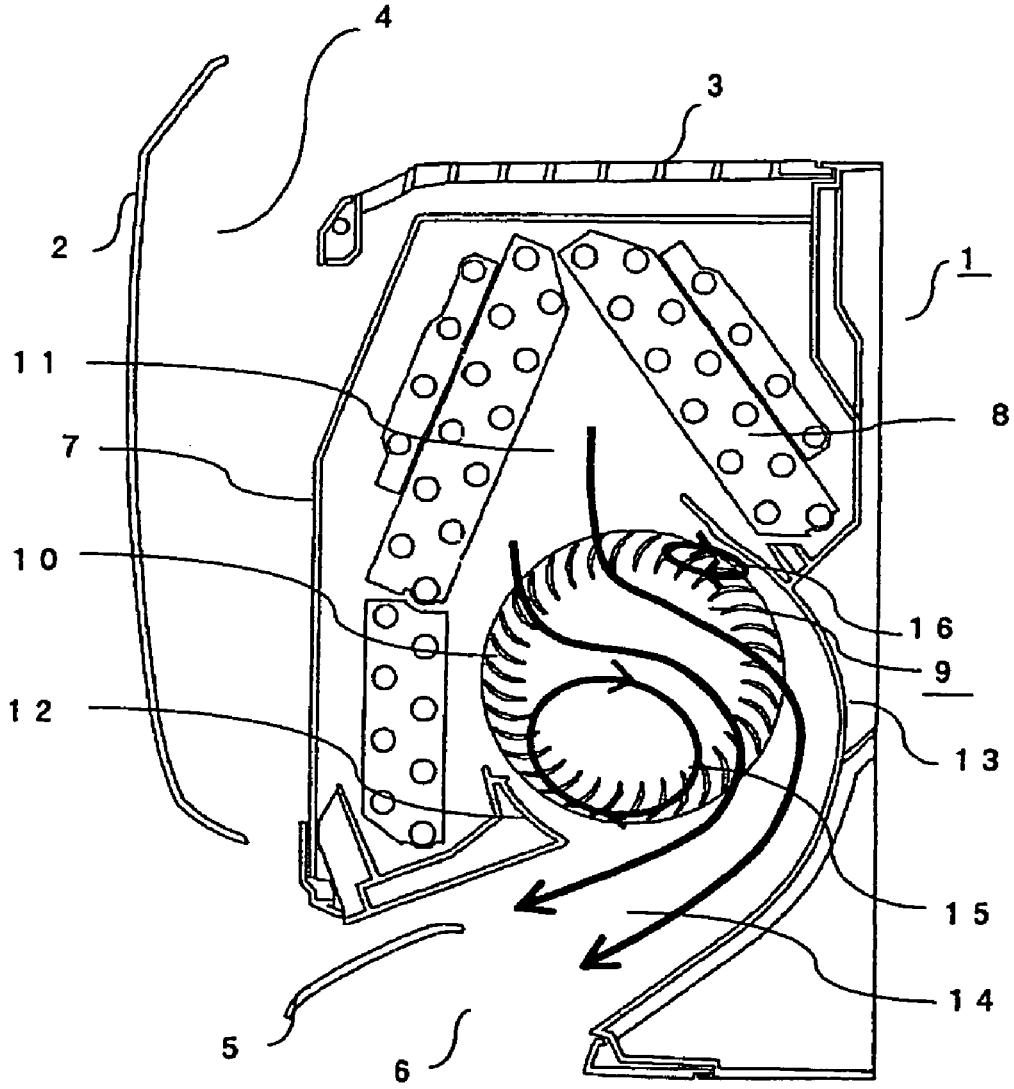
FIG. 1 is a sectional structural view of an indoor unit of an air conditioner according to a first embodiment of the present invention.

FIG. 1 is a sectional view of an indoor unit of an air conditioner according to a first embodiment of the present invention. In the drawing, the indoor unit 1 of the air conditioner is installed in a room, and an air inlet 4 covered with a front panel 2 and a top grill 3 is provided at the upper front of the indoor unit 1 so as to oppose the room inside. Also, an air outlet 6 having an opening restricted in direction and area with a wind-direction adjusting vane 5 is provided at the lower front of the unit. Sequentially, an air flow-path extending from the air inlet 4 to the air outlet 6 is formed. In the midstream of the air flow-path, a pre-filter 7 for eliminating foreign materials contained in the flowing room air, a heat exchanger 8 for exchanging heat between refrigerant flowing through piping and the flowing room air, and a cross-flow fan 9 are arranged. The cross-flow fan 9 is composed of a cylindrical fan body extending in the direction of the rotational axis, including an impeller 10 for blowing air by rotation, and a stabilizer 12 and a casing 13, which are arranged with the impeller 10 therebetween for guiding air from the air inlet 4 toward the air outlet 6. An area upstream the impeller 10 forms an air inhaling flow-path 11 surrounded with the heat exchanger 8, and an area downstream the impeller 10 forms an air blowing-off flow-path 14 defined by the stabilizer 12 and the casing 13. Arrows in the drawing indicate the flowing direction of room air, and a cross-flow eddy 15 and an eddy 16 are generated due to the flow-path shape. According to the embodiment, the cross-flow eddy 15 generated in the vicinity of the stabilizer 12 is stabilized and noise generated in this vicinity is reduced.

The heat exchanger 8 housed in the indoor unit shown in FIG. 1 constitutes a refrigeration cycle together with a compressor, an outdoor heat exchanger, and pressure reducing means, which are generally housed in an outdoor unit of the air conditioner, so as to circulate refrigerant through connected piping. The high-temperature and high-pressure refrigerant gas compressed by the compressor is condensed by a condenser into a two-phase gas-liquid state or a gas phase state so as to decompress it by the pressure reducing means. Then, the low-temperature and low-pressure liquid refrigerant evaporated in an evaporator to be a high-temperature gas is again inhaled into the compressor. In this refrigeration cycle, when the heat exchanger housed in the indoor unit is operated as the condenser, room heating can be performed. On the contrary, when being operated as the evaporator, room cooling can be performed.

Next, operation of the indoor unit of the air conditioner will be described. In the air conditioner constructed as in FIG. 1, first, upon turning on power supply, when refrigerant passes through the heat exchanger 8 of the indoor unit 1, and the impeller 10 of the cross-flow fan 9 is rotated, room air inhaled from the air inlet 4 flows through the heat exchanger 8 after dust included in the air is eliminated by the pre-filter 7 so as to be heat-exchanged the refrigerant passing through the piping of the heat exchanger 8. Then, the air is allowed to blow out of the air outlet 6 into the room and then, inhaled again into the air inlet 4. By repeating the series of operation, the dust in room air is eliminated and the room air is cooled or heated by being heat-exchanged with the refrigerant of the heat exchanger 8 so that quality of the room air is changed.

When the impeller 10 is rotated, air blowing off out of the impeller 10 flows toward the air blowing-off flow-path 14; however, part of the air collides with an opposing surface of the stabilizer 12 so as to proceed toward the air inhaling flow-path 11 after passing through the vicinity of the opposing surface so as to be inhaled in the impeller 10. Therefore, the cross-flow eddy 15 is formed inside the impeller.

When considering the gap between the impeller 10 and the stabilizer 12, the narrower the gap, the air flowing through the gap is more stabilized, improving the blowing efficiency, but, broad band noise due to the collision of the high-speed air blowing off out of the impeller 10 with the stabilizer 12 is more increased. Conversely, the broader the gap between the impeller 10 and the stabilizer 12, the broad band noise is more reduced, but the air flowing through the gap becomes more unstable, deteriorating the blowing efficiency and generating the back flow from the outlet toward the impeller. That is, it is difficult to satisfy both the noise reduction and the improvement in blowing performance.

Figure 2:
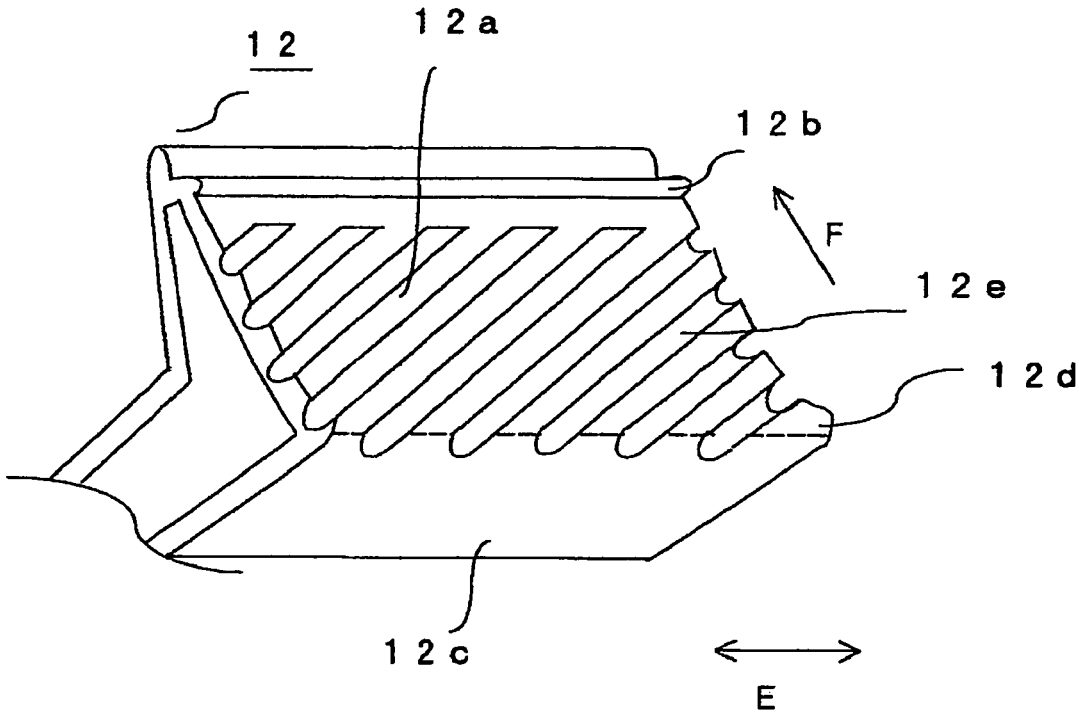
FIG. 2 is a perspective view of a stabilizer according to the first embodiment of the present invention.
Figure 3:
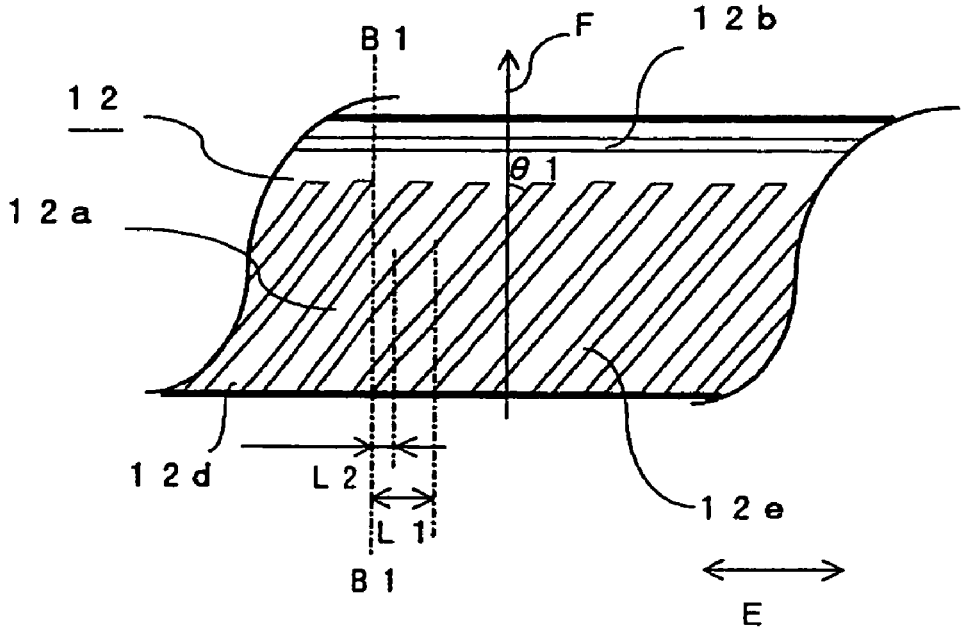
FIG. 3 is an explanatory view showing an air stream flowing in the vicinity of the stabilizer according to the first embodiment of the present invention, in which FIG. 3(*a*) is a front view of the stabilizer and FIG. 3(*b*) is a sectional view of the stabilizer.
Figure 3:
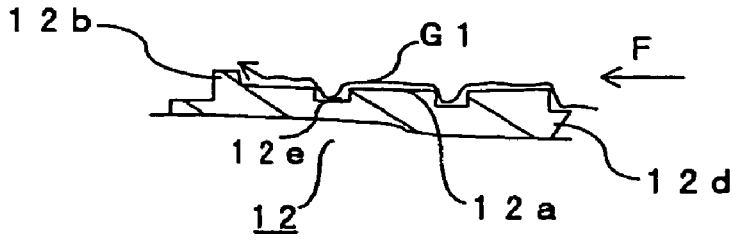

FIG. 2 is an enlarged perspective view of the stabilizer 12 according to the embodiment; FIG. 3 includes drawings for illustrating the action of the stabilizer 12 relative to the air flow in the vicinity of the impeller 10 according to the embodiment, in which FIG. 3(*a*) is a front view of the stabilizer 12 viewed from a surface opposing the impeller 10, and FIG. 3(*b*) is a sectional view along the line B1-B1 of FIG. 3(*a*). In the drawings, arrow E indicates the rotational axis direction of the impeller, and arrows F and G1 indicate the air flowing direction.

The stabilizer 12 is arranged to oppose the impeller 10, and on a stabilizer opposing surface 12*a*, air flows in arrow F direction by the rotation of the impeller 10. At the leading end on the downstream side of the air flowing on the stabilizer opposing surface 12*a*, a projection 12*b* extending in the rotational axis direction E and protruding toward the impeller 10 is formed. The distance between the tip of the projection 12*b* and the impeller 10 is the shortest distance between the stabilizer 12 and the impeller 10. Also, the leading end 12*d* on the upstream side of the air flowing on the stabilizer opposing surface 12*a* is curved, for example, and the air flow blowing off out of the impeller 10 branches into a flow toward a blowing-off flow-path section 12*c* and a flow toward the stabilizer opposing surface 12*a* at the leading end 12*d*. Furthermore, over the range of the stabilizer opposing surface 12*a* from the upstream side of the projection 12*b* to the leading end 12*d*, a plurality of grooves 12*e* are juxtaposed, each being inclined to the flowing direction F at an angle θ1, where in the groove 12*e*, the inclined angle θ1=45°; L1=5 mm; and L2=2 mm, for example.

The shortest distance between the stabilizer 12 and the impeller 10 widely contributes to maintaining the blowing performance and stabilizing the cross-flow eddy 15. The shortest distance uniform over the entire width of the impeller 10 in the rotational axis direction E also widely contributes to maintaining the blowing performance and stabilizing the cross-flow eddy 15. At the leading end on the downstream side of the stabilizer opposing surface 12*a*, the projection 12*b* herein is provided so as to define the shortest distance between the stabilizer 12 and the impeller 10 with this portion. Hence, the blowing performance can be maintained and the cross-flow eddy 15 can be stabilized.

As shown in FIG. 3(*a*), (*b*), a plurality of the grooves 12*e* are juxtaposed approximately in parallel to each other, each having an angle of inclination θ1 to the flowing direction F, so that a plurality of concave portions, three portions herein, for example, are formed along the opposing surface 12*a* in the flowing direction F while convex portions are formed along the base surface of the opposing surface 12*a* so as to have convex-concave portions. The air F flowing through the opposing surface 12*a*, as shown in FIG. 3(*b*), becomes the flow G1 waved along the convex-concave portions so as to generate micro turbulences in rising or falling portions of the convex-concave portions.

Figure 4:
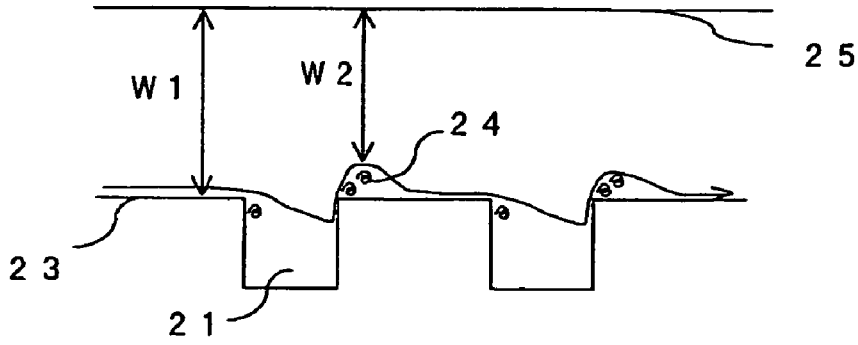
FIG. 4 is an explanatory view showing a situation in that air stream turbulences are generated with concave or convex portions according to the first embodiment of the present invention, in which FIG. 4(*a*) shows a case of the concave portions and FIG. 4(*b*) shows a case of the convex portions.
Figure 4:
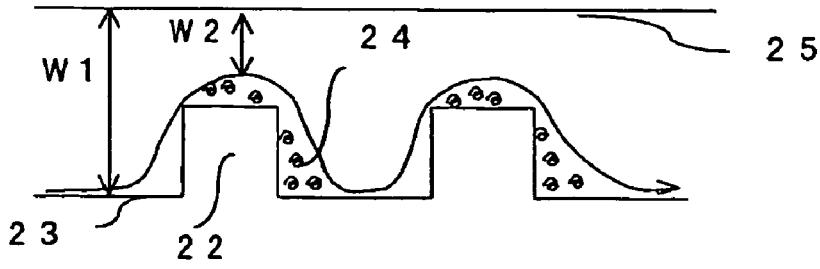

The turbulence generated in air flow by the convex-concave portions will be generally described with reference to FIG. 4. FIG. 4(*a*) shows a case where a groove 21 is provided to have the concave portion; FIG. 4(*b*) shows a case where a projection 22 is provided to have the convex portion, and wherein numeral 23 denotes a base surface.

In FIG. 4(*a*), the air flowing along the base surface 23 slightly enters into the groove 21 at the falling portion of the concave portion 21 and flows upwardly at the rising portion so as to flow above the base surface 23, so that the air flows wavelike and up and down. A turbulence 24 is generated in the vicinity of the downstream of the falling or rising portion. In the case of the projection 22, in the same way, in FIG. 4(*b*), the air flowing along the base surface 23 flows upwardly along the rising portion of the projection 22 and downwardly along the falling portion, so that the air flows wavelike and up and down. The turbulence 24 is generated in the vicinity of the downstream of the falling or rising portion. The turbulence 24 acts to stabilize the cross-flow eddy 15.

In a case where the concave or convex portion is formed in a flow path with the same distance to an opposing wall 25, and the height of the convex portion is identical to the depth of the concave portion, a principal flow width before passage (W1) is compared with a principal flow width after passage (W2). As is apparent from the comparison of W2/W1, change in principal flow width of the convex portion is larger than that of the concave portion. In such a manner, since the principal flow width is largely changed, it may be said that the convex portion generates the turbulence larger than the concave portion does.

As shown in FIG. 3(*b*), by forming the concave or convex portion on the base surface of the stabilizer opposing surface 12*a* so as to generate the turbulence, energy is applied to the cross-flow eddy 15 having the turbulence generated in the impeller 10 while the turbulence acts to suppress the spread of the cross-flow eddy 15. Sequentially, the cross-flow eddy 15 is stabilized. By stabilizing the cross-flow eddy 15, the reverse inhalation between the impeller 10 and the stabilizer opposing surface 12*a* can be prevented. The reverse inhalation herein means that air is inhaled from the air outlet 6 into the impeller 10 by the cross-flow eddy 15 drawing the air in. This causes deterioration in blowing performance. Hot air in the room is inhaled from the air outlet 6, especially when the air conditioner is in a cooling mode, so that the hot air is cooled by the wall of the air blowing-off flow-path 14 and the impeller 10. As a result, dew is formed, causing dew splash in the room by the air blowing off out of the air outlet 6. Conversely, this can be prevented by preventing the reverse inhalation.

When the rotating impeller 10 passes by the stabilizer opposing surface 12*a*, a large change in pressure is produced so as to generate wind noise which is the narrow band noise. However, by providing a plurality of the grooves 12*e* in a range from the opposing surface 12*a* to the leading end 12*d* on the upstream side, the pressure change is reduced because the distance between the impeller 10 and the stabilizer opposing surface 12*a* is increased by the depth of the groove 12*e*, decreasing the noise.

In particular, if the grooves 12*e* are provided so as to include the leading end 12*d* on the upstream side, the pressure change at the leading end 12*d* on the upstream side can be reduced, thereby reducing the noise originated from this region. Accordingly, when a plurality of the inclined grooves 12*e* are provided at least at the leading end 12*d* on the upstream side, the noise can be reduced.

Furthermore, the grooves 12*e* are provided so as to have an angle of inclination θ1 to the flowing direction F, so that the position of the concave or convex portion are arranged apart in the rotational axis direction E. Hence, when considering wind noise produced by interference between one vane constituting the impeller 10 and one groove 12*e*, the time when the pressure change is produced by the interaction between both the elements is changed along the rotational axis direction E, so that the noise is dispersed and further reduced.

The wind noise can be reduced by slightly reducing the angle of inclination θ1 from 90°, for example to 80°.

Figure 5:
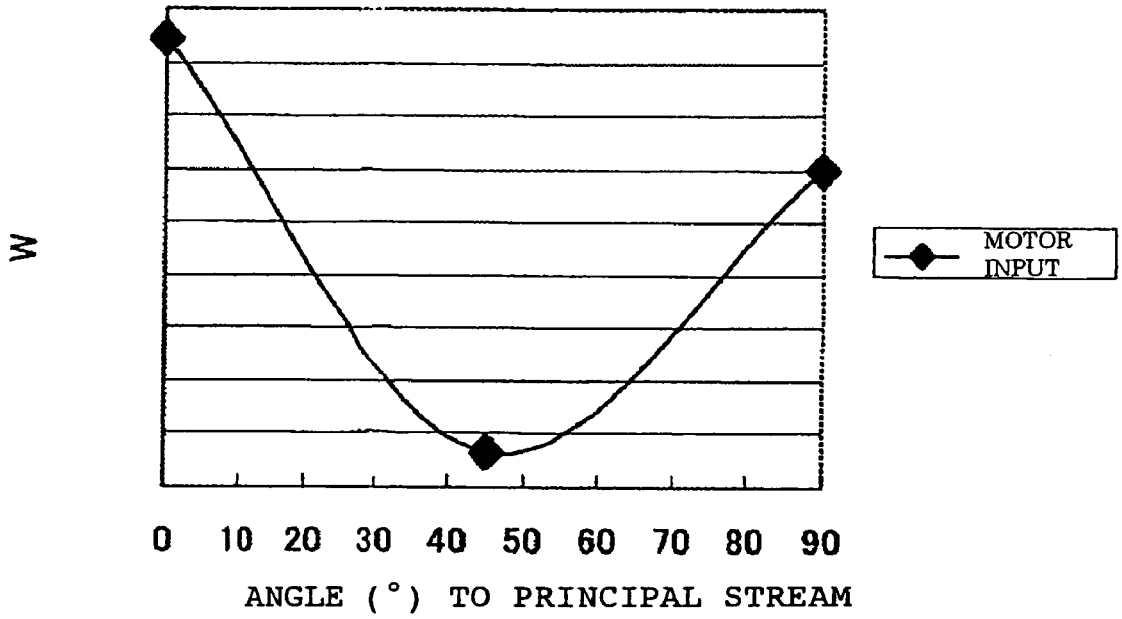
FIG. 5 is a graph showing the relationship between an inclination angle of grooves and a motor input according to the first embodiment of the present invention.
Figure 6:
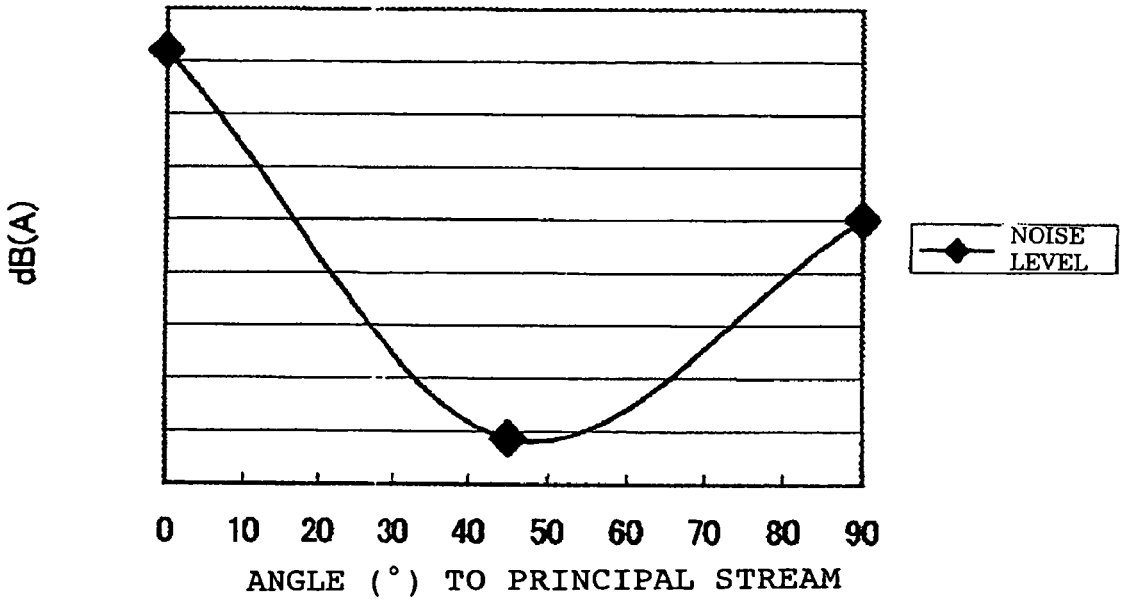
FIG. 6 is a graph showing the relationship between the inclination angle of the grooves and a noise level according to the first embodiment of the present invention.

Then, in order to further consider the optimum angle of inclination θ1, the relationship between the angle of inclination θ1 to the air flow of the groove 12*e* formed on the stabilizer opposing surface 12*a*, and the motor input or the noise level will be described. In respective FIGS. 5 and 6, abscissa indicates the inclination angle (°) of the groove to the direction of air flowing along the stabilizer opposing surface 12*a*; ordinate in FIG. 5 indicates the motor input (W), and in FIG. 6 shows the noise level (dB(A)). FIGS. 5 and 6 show the relationship when the angle of inclination θ1 is changed, provided that the air quantity is maintained at the same level as that in a practical use. This is a case where the grooves 12*e* are formed on the entire surface along from the upstream of the projection 12*b* on the downstream side of the stabilizer opposing surface 12*a* to the leading end 12*d* on the upstream side.

As shown in FIG. 5, when the angle of inclination θ1 of the groove relative to the flowing direction F is set in a range from 30° to 70°, the test result was obtained that the blowing performance was improved so as to obtain the fan 9 with a low motor input. Also, as shown in FIG. 6, when the angle of inclination θ1 of the groove 12*e* relative to the flowing direction F is set in a range from 30° to 70°, the test result was obtained that the relationship between the impeller 10 and the concave-convex portions was improved so as to reduce the value of noise due to the interference between both the elements. That is, in view of reduction in motor input and noise, it is preferable that the angle of inclination θ1 of the groove relative to the flowing direction F be set in a range from 30° to 70°.

Figure 7:
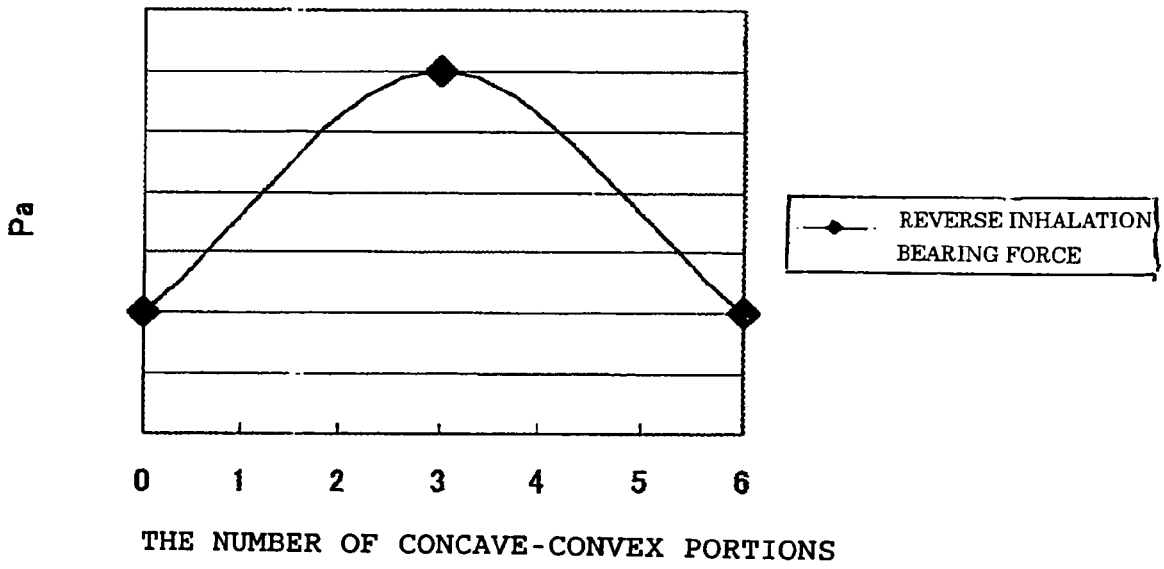
FIG. 7 is a graph showing the relationship between the number of the concave portions and a reverse inhalation bearing force according to the first embodiment of the present invention.

Then, the relationship between the number of concave portions arranged on the stabilizer opposing surface 12*a* in the flowing direction and the action against the reverse inhalation generation will be described more in detail. In order to produce the waved turbulence G1 effective in preventing the reverse inhalation generation, the groove 12*e* having at least two concave portions across the flowing direction F is formed in the section of the stabilizer 12. In FIG. 7, abscissa indicates the number of concave portions arranged on the stabilizer opposing surface 12*a* across the flowing direction and ordinate indicates the bearing force (Pa) against the reverse inhalation. In the same way as in FIGS. 5 and 6, the relationship herein is shown when the number of concave portions is changed, provided that the air quantity is maintained at the same level as that in a practical use. The bearing force denotes a resistance against air passing on the inhalation side at the time of the generation of the reverse inhalation during operation of gradually increasing the resistance on the inhalation side of the cross-flow fan. It is admitted that with increasing bearing force against the reverse inhalation, the cross-flow eddy becomes stable and the reverse inhalation is difficult to occur. When this result was obtained, the groove 12*e* was entirely formed in a range from the upstream of the projection 12*b* on the downstream side of the stabilizer opposing surface 12*a* to the leading end 12*d* on the upstream side.

As shown in FIG. 7, by providing two to five concave portions across the flowing direction F, the large bearing force against the reverse inhalation can be obtained. That is, by providing two to five concave portions, the cross-flow eddy 15 is stabilized and the reverse inhalation is difficult to be generated although the resistance against air passing is large on the inhalation side.

As described above, the projection 12*b* is arranged at the leading end on the downstream side of air flowing on the stabilizer opposing surface 12*a* so as to protrude toward the impeller 10, defining the shortest distance to the impeller 10, and a plurality of the grooves 12*e* are arranged on the upstream side of the projection 12*b* so as to disturb air flowing on the opposing surface 12*a*. Whereby the positions of the grooves 12*e* are arranged apart in the rotational axis direction E of the impeller 10, so that the reverse inhalation can be prevented and noise can be reduced. Accordingly, the noise increase and dew splash into a room in the cooling mode accompanied by the reverse inhalation can also be prevented, so that users may comfortably use the air conditioner.

Also, by providing the grooves 12*e* at least at the leading end 12*d* on the upstream side of air flowing on the stabilizer opposing surface 12*a*, the pressure change in that portion is further reduced, so that the noise can be further decreased.

By forming a plurality of the grooves 12*e* extending to intersect the direction of air flowing on the opposing surface 12*a*, an air conditioner effective in preventing the reverse inhalation and in reducing noise can be obtained with a comparatively simple structure. In particular, with a simple structure in that a plurality of the grooves 12*e* are obliquely arranged on the stabilizer opposing surface 12*a*, a large number of turbulences can be generated in the air flowing direction F while interference noise between the impeller 10 and the concave-convex portions can be dispersed, reducing cost.

The grooves 12*e* have an angle of inclination relative to the air flowing on the stabilizer opposing surface 12*a* in a range of 30° to 70°, so that the concave-convex portions formed on the stabilizer opposing surface 12*a* are arranged apart in the rotational axis direction E, and wind noise generated by the relationship between the rotation of the impeller 10 and the stabilizer opposing surface 12*a* is further dispersed, reducing noise to a large extent.

In the above description, the grooves 12*e* are formed on the stabilizer 12. Alternatively, as shown in FIG. 4(*b*), a plurality of projections inclined at an angle of θ1 to the air flowing direction may be juxtaposed as convex portions. However, these projections must not protrude closer to the impeller 10 than the projection 12*b* arranged at the leading end on the downstream side of the air flowing on the stabilizer opposing surface 12*a* so as to define the shortest distance. As shown in FIG. 4, the projections formed on the opposing surface 12*a* have an advantage that the turbulence larger than that of the concave portions can be generated.

Since the impeller 10 is arranged very close to the stabilizer 12 and also has a limit in construction, even when the concave portions generating the smaller turbulence are provided, the cross-flow eddy can be sufficiently stabilized.

According to the embodiment, the cross-flow eddy can be stabilized with the concave-convex portions, so that the distance between the impeller 10 and the stabilizer 12 may be widened to some extent. This causes further reduction in noise.

Figure 9:
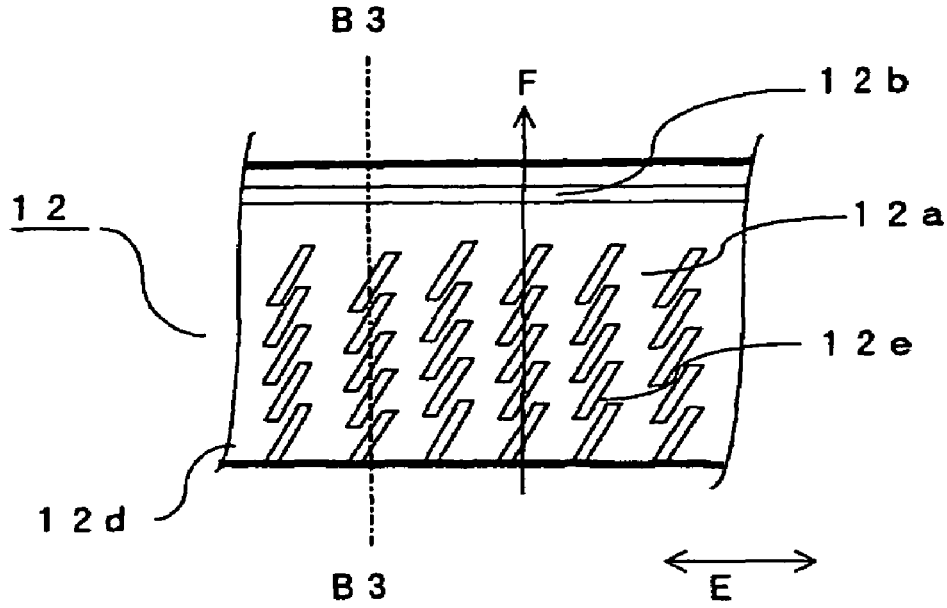
FIG. 9 is an explanatory view showing an air stream flowing in the vicinity of the stabilizer of still another example according to the first embodiment of the present invention, in which FIG. 9(*a*) is a front view of the stabilizer and FIG. 9(*b*) is a sectional view of the stabilizer.
Figure 9:
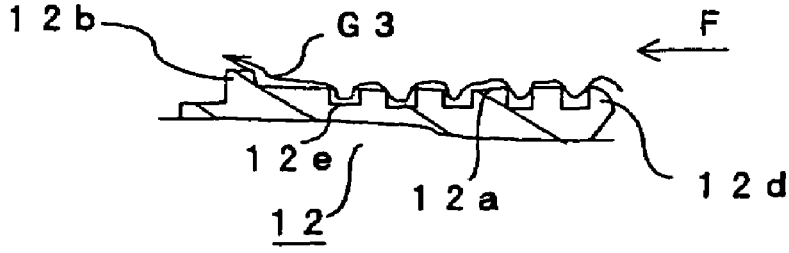
Figure 10:
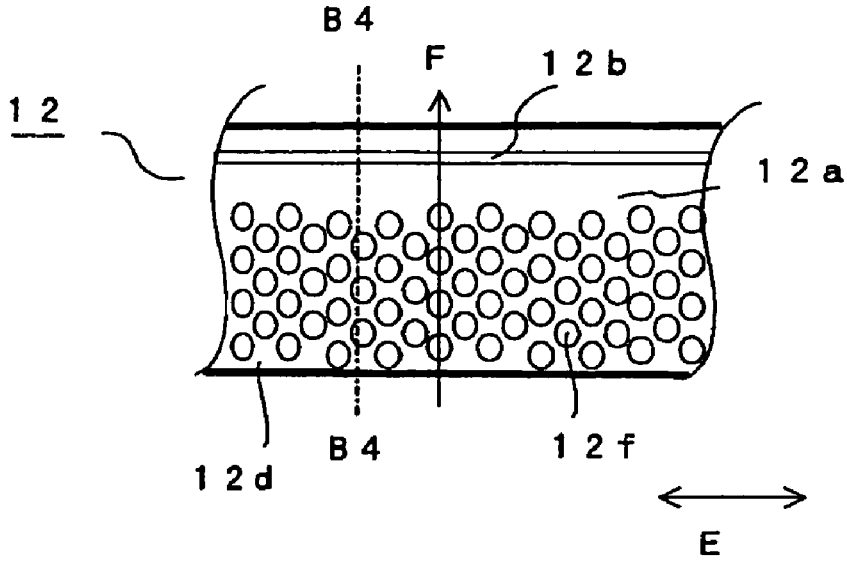
FIG. 10 is an explanatory view showing an air stream flowing in the vicinity of the stabilizer of further another example according to the first embodiment of the present invention, in which FIG. 10(*a*) is a front view of the stabilizer and FIG. 10(*b*) is a sectional view of the stabilizer.
Figure 10:
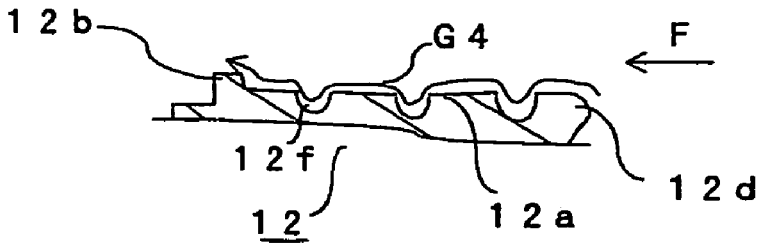

According to the embodiment, a plurality of the grooves 12*e* inclined to the air flowing direction are juxtaposed, in which the concave-convex portions generating turbulences on the stabilizer opposing surface 12*a* and being arranged apart in rotational axis direction E are provided. Alternatively, other examples are shown in FIGS. 8 to 10.

Figure 8:
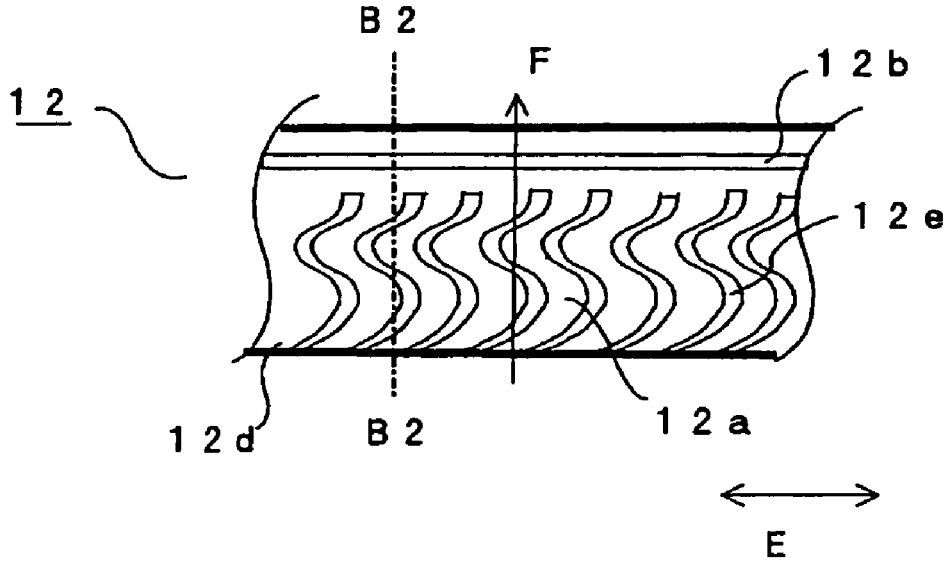
FIG. 8 is an explanatory view showing an air stream flowing in the vicinity of the stabilizer of another example according to the first embodiment of the present invention, in which FIG. 8(*a*) is a front view of the stabilizer and FIG. 8(*b*) is a sectional view of the stabilizer.
Figure 8:
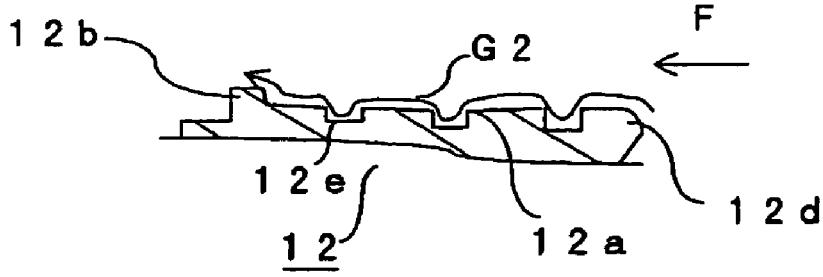

FIG. 8 shows another example of the stabilizer 12, in which FIG. 8(*a*) is a front view of the stabilizer 12 viewed from the surface 12*a* opposing the impeller 10, and FIG. 8(*b*) is a sectional view at the line B2-B2 of FIG. 8(*a*). Here, the shape of a plurality of the grooves 12*e* formed on the stabilizer opposing surface 12*a* is not straight but meandering.

By such grooves 12*e*, a plurality of the concave-convex portions, three concave portions herein, for example, are formed on the stabilizer opposing surface 12*a*. Hence, the air flowing along the stabilizer opposing surface 12*a* in the arrow F direction is waved, and flows while generating turbulences. That is, as shown by arrow G2 in FIG. 8(*b*), the air flows from the leading end 12*d* on the upstream side toward the projection 12*b* arranged at the leading end on the downstream side along the opposing surface 12*a* while waving up and down in a direction perpendicular to the opposing surface 12*a*.

Thus, in the same way as in the configuration shown in FIG. 3, the cross-flow eddy 15 is stabilized with the turbulence and the reverse inhalation generation can be prevented. Furthermore, the concave-convex portions are arranged apart in the rotational axis direction E, so that the pressure change produced at the time when the impeller 10 passes along the stabilizer opposing surface 12*a* is decreased, reducing wind sound. Since the grooves 12*e* are arranged at least at the leading end 12*d* on the upstream side, the noise can be further reduced.

FIG. 9 shows still another example of the stabilizer 12, in which FIG. 9(*a*) is a front view of the stabilizer 12 viewed from the surface 12*a* opposing the impeller 10, and FIG. 9(*b*) is a sectional view along the line B3-B3 in FIG. 9(*a*). Here, the shape of a plurality of the grooves 12*e* formed on the stabilizer opposing surface 12*a* is aggregation of discontinuous oblique grooves 12*e*.

By such grooves 12*e*, a plurality of the concave-convex portions, five concave portions in FIG. 9(*b*) herein, for example, are formed on the stabilizer opposing surface 12*a*. Hence, the air flowing along the stabilizer opposing surface 12*a* in the arrow F direction is waved, and it flows while generating turbulences. That is, as shown by the arrow G3 of FIG. 9(*b*), the air flows from the leading end 12*d* on the upstream side toward the projection 12*b* arranged at the leading end on the downstream side along the opposing surface 12*a* while waving up and down mainly in a direction perpendicular to the opposing surface 12*a*.

Thus, in the same way as in the configuration shown in FIG. 3, the cross-flow eddy 15 is stabilized with the turbulence and the reverse inhalation generation can be prevented. Furthermore, the concave-convex portions are arranged apart in the rotational axis direction E, so that the pressure change produced at the time when the impeller 10 passes along the stabilizer opposing surface 12*a* is decreased, reducing wind sound. Since the grooves 12*e* are arranged at least at the leading end 12*d* on the upstream side, the noise can be further reduced.

According to this example, some air flows in the arrow F direction along portions without the concave-convex portions of the opposing surface 12*a* depending on the position in the rotational axis direction; in this case also, the air flow is influenced by the concave-convex portions in the vicinity or by the turbulence produced with the concave-convex portions, so that the same advantages as those of FIGS. 3 and 8 are obtained.

FIG. 10 shows another example of the stabilizer 12, in which FIG. 10(*a*) is a front view of the stabilizer 12 viewed from the surface 12*a* opposing the impeller 10, and FIG. 10(*b*) is a sectional view along the line B4-B4 of FIG. 10(*a*). Here, a plurality of dimples 12*f* are formed on the stabilizer opposing surface 12*a*.

By such dimples 12*f*, a plurality of the concave-convex portions, three concave portions in FIG. 10(*b*) herein, for example, are formed on the stabilizer opposing surface 12*a*. Hence, the air flowing along the stabilizer opposing surface 12*a* in arrow F direction is waved, and it flows while generating turbulences. That is, as shown by arrow G4 of FIG. 10(*b*), the air flows from the leading end 12*d* on the upstream side toward the projection 12*b* arranged at the leading end on the downstream side along the opposing surface 12*a* while waving up and down in a direction perpendicular to the opposing surface 12*a*.

Thus, in the same way as in the configuration shown in FIG. 3, the cross-flow eddy 15 is stabilized with the turbulence and the reverse inhalation generation can be prevented. Furthermore, the concave-convex portions are arranged apart in the rotational axis direction E, so that the pressure change produced at the time when the impeller 10 passes along the stabilizer opposing surface 12*a* is decreased, reducing wind sound. Since the dimples 12*f* are arranged at least at the leading end 12*d* on the upstream side, the noise can be further reduced.

According to this example, the produced turbulence differs in accordance with the arrangement of the dimples 12*f*; however, by forming at least two concave portions arrange in the direction F, the same advantages as those of FIG. 3, 8, or 9 are obtained.

In respective FIGS. 8 to 10, the concave-convex portions may also be formed on the opposing surface 12*a* across the flowing direction F by providing projections with a height lower than that of the projection 12*b* instead of the grooves 12*e*.

By shallowly inscribing the stabilizer opposing surface 12*a* to have not a smooth surface but a corrugated surface, the air flow is also disturbed with the stabilizer opposing surface 12*a*, so that the reverse inhalation can be prevented. When shallowly inscribing the stabilizer opposing surface 12*a* to have a corrugated surface, the concave-convex portions are necessarily arranged apart in the rotational axis direction, so that noise is also reduced.

Second Embodiment

An indoor unit of an air conditioner according to a second embodiment of the present invention will be described. The sectional structure of the indoor unit according to the embodiment is the same as that shown in FIG. 1, and the air conditioning operation by changing air quality in a room is also the same as that according to the first embodiment, so that the descriptions are omitted.

When considering the gap between the impeller 10 and the casing 13, the narrower the gap, the air flowing through the gap is more stabilized, improving the blowing efficiency. However, broad band noise due to the collision of the high-speed air blowing off out of the impeller 10 with the casing 13 is increased. Conversely, the broader the gap between the impeller 10 and the casing 13, the broad band noise is more reduced. However, the air flowing through the gap becomes unstable, deteriorating the blowing efficiency and generating the back flow from the outlet toward the impeller 10. That is, it is difficult to satisfy both the noise reduction and the improvement in blowing performance.

Figure 11:
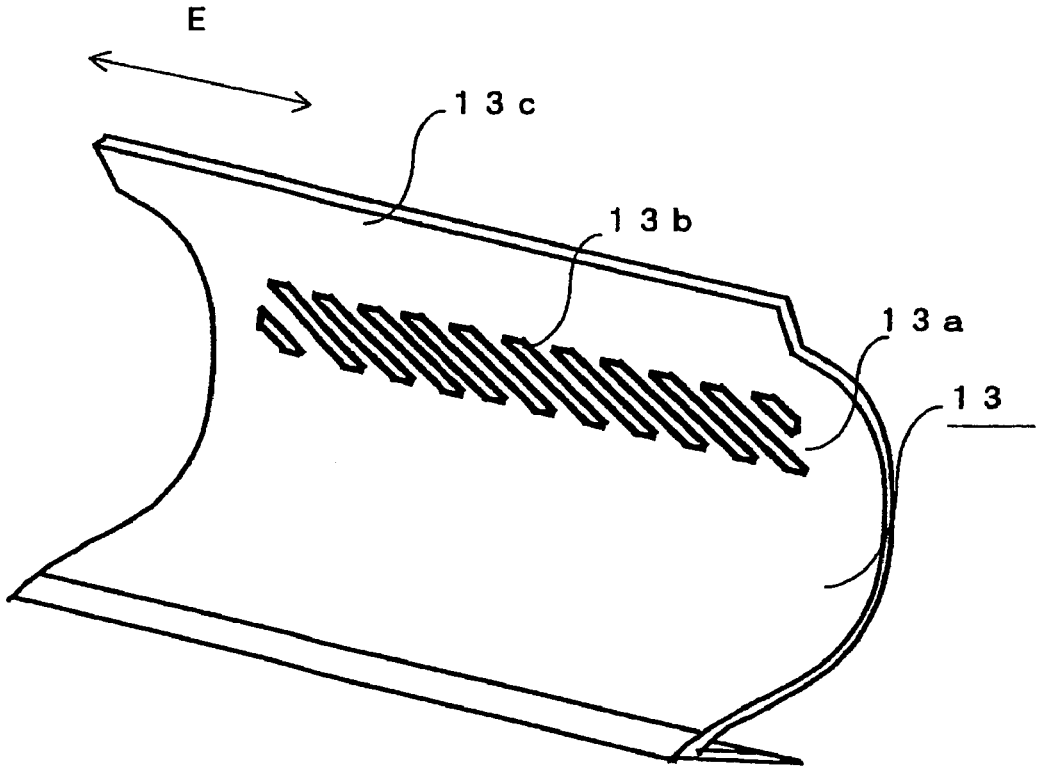
FIG. 11 is a perspective view of a casing according to a second embodiment of the present invention.
Figure 12:
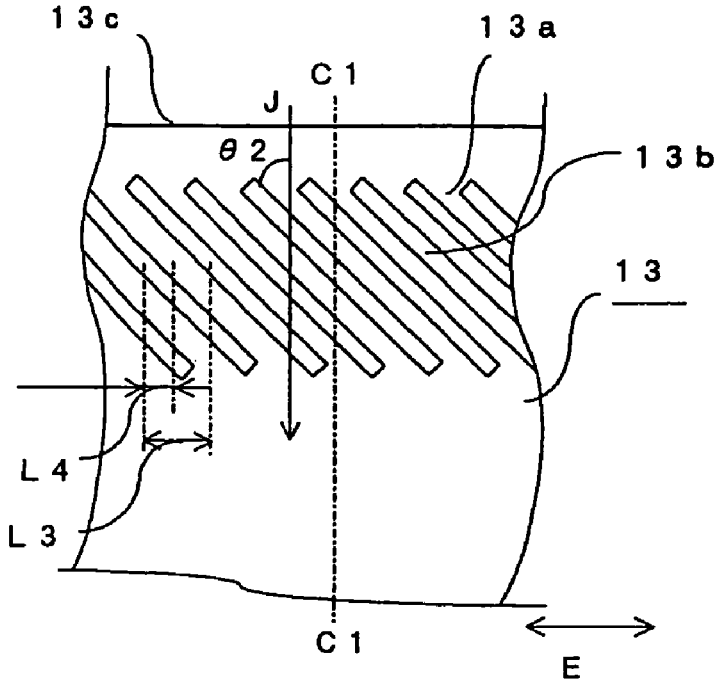
FIG. 12 is an explanatory view showing an air stream flowing in the vicinity of the casing according to the second embodiment of the present invention, in which FIG. 12(*a*) is a front view of the casing and FIG. 12(*b*) is a sectional view of the casing.
Figure 12:
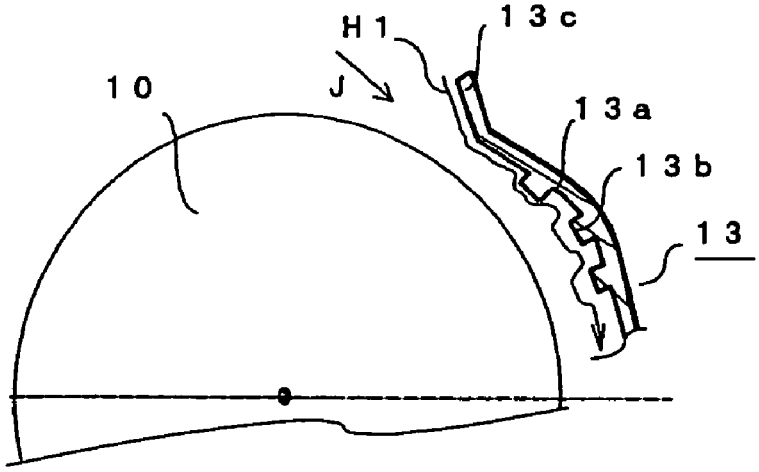

FIG. 11 is a perspective view of the casing 13 according to the embodiment; FIG. 12 includes drawings for illustrating the action of the casing 13 relative to the air flow in the vicinity of the impeller 10 according to the embodiment, in which FIG. 12(*a*) is a front view of the casing 13 viewed from a surface opposing the impeller 10, and FIG. 12(*b*) is a sectional view along the line C1-C1 of FIG. 12(*a*). In the drawings, arrow E indicates the rotational axis direction of the impeller, and arrows J and H1 indicate the air flowing direction.

The casing 13 is arranged to oppose the impeller 10, and on a casing opposing surface 13*a*, air flows in arrow J direction by the rotation of the impeller 10. The casing opposing surface 13*a* has a plurality of projections 13*b* constituting a section protruding toward the impeller 10. In the vicinity of the connection portion between a casing volute tongue portion 13*c* and the casing opposing surface 13*a*, the distance between the casing 13 and the impeller 10 is set shortest. On the casing opposing surface 13*a* continued therefrom, a plurality of the projections 13*b* are juxtaposed, each being inclined to the flowing direction J at an angle θ2, where in the projection 13*b*, the inclined angle θ2=45°; L3=5 mm; and L4=2 mm, for example.

When the impeller 10 is rotated, room air inhaled from the air inlet 4 flows through the air inhaling flow-path 11, and is guided by the casing volute tongue portion 13*c* to the vicinity of the impeller 10. Then, the air is blowing off out of the impeller 10 into the air blowing flow-path 14 and blown into a room through the air outlet 6. At this time, as shown in FIG. 1, the eddy 16 is formed on the opposing surface 13*a* continued from the casing volute tongue portion 13*c*. According to the embodiment, the reverse inhalation is to be prevented and noise in the vicinity of the casing 13 is to be reduced.

As shown in FIG. 12(*a*), (*b*), a plurality of the projections 13*b* are juxtaposed approximately in parallel to each other, each having an angle of inclination θ2 to the flowing direction J. Thus, a plurality of projections, three projections herein in FIG. 12(*b*), for example, are formed on the opposing surface 13*a* across the flowing direction J, while concave portions are formed along the base surface of the opposing surface 13*a*, so that convex-concave portions are formed. The air J flowing along the opposing surface 13*a*, as shown in FIG. 12(*b*), becomes the flow H1 waved along the convex-concave portions so as to generate micro turbulences in rising or falling portions of the convex-concave portions. The situations of the turbulences generated by the concave-convex portions are the same as those shown in FIG. 4(*a*), (*b*), so that the air flows waves up and down, and turbulences are generated in the vicinity of the downstream of the falling or rising portion.

As shown in FIG. 12(*b*), by forming the concave and convex portions on the base surface of the casing opposing surface 13*a* to generate the turbulence, energy is applied to the eddy 16 having the turbulence generated in the impeller 10 while the turbulence acts to suppress the spread of the eddy 16, so as to stabilize the eddy 16. By stabilizing the eddy 16, the reverse inhalation to the impeller 10 can be prevented. The reverse inhalation herein means that air is inhaled from the air outlet 6 into the impeller 10 by the eddy 16 drawing the air in. This causes deterioration in blowing performance. Hot air in the room is inhaled from the air outlet 6, especially when the air conditioner is in a cooling mode, so that the hot air is cooled by the wall of the air blowing flow-path 14 and the impeller 10. As a result, dew is formed, causing dew splash in the room by the air blowing off out of the air outlet 6. This can be prevented by preventing the reverse inhalation.

When the air amount is small, the air flow may be separated from the casing opposing surface 13*a*. The reverse inhalation is liable to be generated especially at this time. Whereas, the leakage flow between the impeller 10 and the opposing surface 13*a* is reduced by providing the projections 13*b*, stopping or reducing the reverse inhalation flowing.

Generally, in order to stabilize the eddy 16 so as to prevent the reverse inhalation, the gap between the impeller 10 and the casing 13 is reduced. Whereas, according to the embodiment, turbulences are generated with a plurality of the projections 13*b* to stabilize the eddy 16, so that the gap between the impeller 10 and the casing 13 may be slightly widened. When the rotating impeller 10 passes along the casing opposing surface 13*a*, large change in pressure is produced so as to generate wind noise which is the narrow band noise; however, since the gap between the impeller 10 and the casing 13 can be widened so as to reduce the pressure change in this portion, the noise can be reduced.

When the projections 13*b* are located in the vicinity of the position where the eddy 16 is generated, the turbulence energy is liable to be effectively transferred to the eddy 16. If a plurality of the projections 13*b* are arranged at least along a range from the vicinity of the casing volute tongue portion 13*c* to the upstream of the horizontal plane including the rotational axis of the impeller 10, the eddy 16 can be stabilized. FIG. 12(*b*) shows the horizontal plane including the rotational axis of the impeller 10 with a doted line.

Furthermore, the projections 13*b* are provided to intersect the flowing direction J at the inclination angle θ2 to the flowing direction J, so that the position of the concave portion or the convex portion is arranged apart in the rotational axis direction E. Thus, in consideration of wind sound produced by the interference between one vane constituting the impeller 10 and one projection 13*b*, the time when the pressure change is produced by interaction between both the elements is changed along the rotational axis direction E, so that the noise is further dispersed and reduced.

The wind sound can be reduced by slightly reducing the inclination angle θ2 from 90°, for example to about 80°.

Also, the same test results about the relationship herein between the inclination angle θ2 relative to the air flow and the motor input or the noise level were obtained as that shown in FIGS. 5 and 6. That is, as shown in FIG. 5, by defining the inclination angle θ2 of the projection 13*b* relative to the flowing direction J to be from 30° to 70°, the test result was obtained that the blowing performance was improved so as to obtain the fan 9 with a low motor input. As shown in FIG. 6, when the inclination angle θ2 of the projection 13*b* relative to the flowing direction J is set in a range from 30° to 70°, the test result was also obtained that the relationship between the impeller 10 and the concave-convex portions was improved so as to reduce the noise level due to the interference between both the elements. That is, in view of the reduction in motor input and noise, it is preferable that the inclination angle θ2 of the projection 13*b* relative to the flowing direction be set in a range from 30° to 70°.

Furthermore, the same test result as that shown in FIG. 7 have been obtained that the relationship between the number of projections arranged apart across the direction of air flowing along the casing opposing surface 13*a* and the bearing force against the reverse inhalation. That is, providing two or more projections is effective: as shown in FIG. 7, by providing two to five projections across the air flowing direction J, turbulences are generated on the casing opposing surface 13*a* so as to have a large bearing force against the reverse inhalation. In other words, by providing two to five projections 13*b*, although the blowing resistance on the inhalation side is large, the eddy 16 can be stabilized for preventing the reverse inhalation.

As described above, a plurality of the projections 13*b* are provided to disturb the air flowing on the casing opposing surface 13*a* and the projections 13*b* are arranged apart in the rotational axis direction E, so that the reverse inhalation is prevented and noise can be reduced. Accordingly, increase in noise and dew splash into a room in the cooling mode, which are accompanied by the reverse inhalation, can be prevented so that users may comfortably use the air conditioner.

By providing the projections 13*b* at least above the horizontal plane including the rotational axis of the impeller 10, the pressure change in this portion can be reduced, further reducing the noise.

A plurality of the projections 13*b* extending in a direction intersecting the direction of air flowing on the casing opposing surface 13*a* at an inclination angle in the range of 30° to 70° are juxtaposed so that the concave-convex portions formed on the casing opposing surface 13*a* are arranged apart in the rotational axis direction E and the wind sound produced by the relationship between the rotation of the impeller 10 and the casing opposing surface 13*a* is largely dispersed, reducing the noise to the large extent. By juxtaposing a plurality of the projections 13*b* extending in a direction intersecting the direction of air flowing on the casing opposing surface 13*a*, an air conditioner effective in preventing the reverse inhalation and in reducing noise can be obtained with a comparatively simple structure. In particular, with a simple structure in that a plurality of the projections 13*b* are arranged on the casing opposing surface 13*a*, a large number of turbulences can be generated in the air flowing direction J while the interference noise between the impeller 10 and the concave-convex portions can be dispersed, reducing cost.

For the casing opposing surface 13*a*, in the same way as for the stabilizer 12, a plurality of grooves may be juxtaposed so as to have an inclination angle θ2 relative to the flowing direction and to generate turbulences contributing to stabilizing the eddy 16. However, since the gap between the casing 13 and the impeller 10 has a room in comparison to the case of the stabilizer 12, the projection is more preferable. As shown in FIG. 4(*b*), when the protrusion portion is formed rather with a projection, the difference of the principal flow width between the width before passing and that after passing can be increased so as to generate large turbulences, so that a large advantage can be obtained. Furthermore, in the case where the casing 13 is molded with thin plastics, if the protrusion portion is formed rather with a projection, the strength can be maintained.

Figure 14:
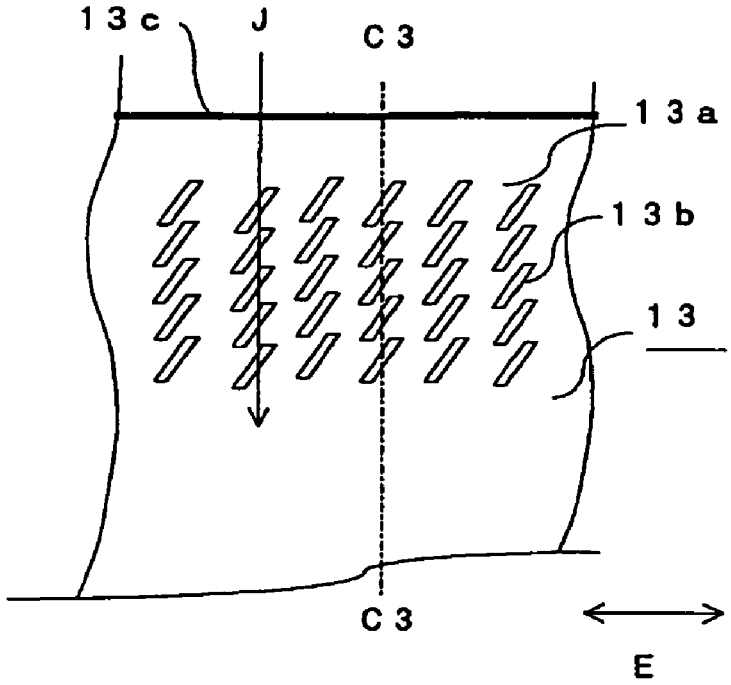
FIG. 14 is an explanatory view showing an air stream flowing in the vicinity of the casing of still another example according to the second embodiment of the present invention, in which FIG. 14(*a*) is a front view of the casing and FIG. 14(*b*) is a sectional view of the casing.
Figure 14:
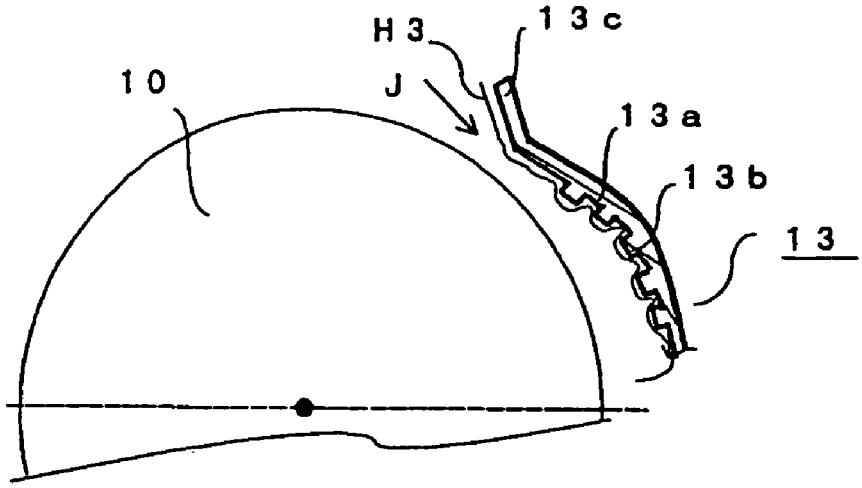
Figure 15:
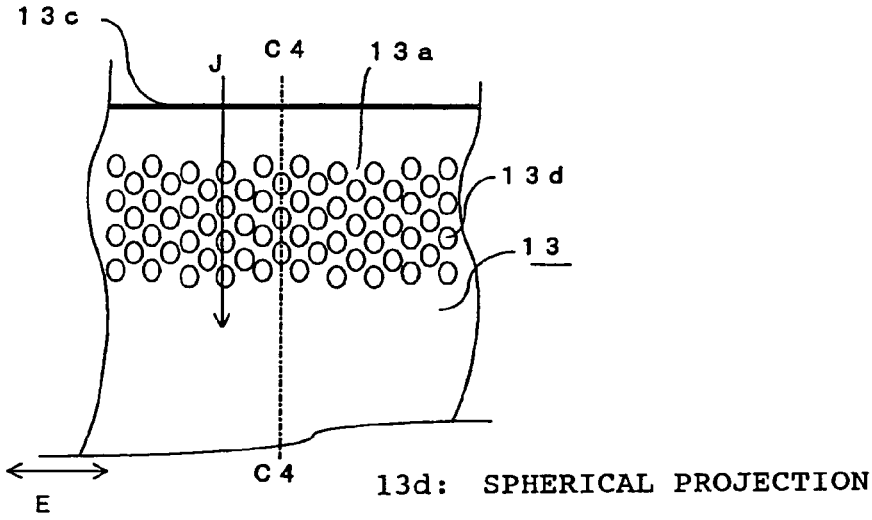
FIG. 15 is an explanatory view showing an air stream flowing in the vicinity of the casing of further still another example according to the second embodiment of the present invention, in which FIG. 15(*a*) is a front view of the casing and FIG. 15(*b*) is a sectional view of the casing.
Figure 15:
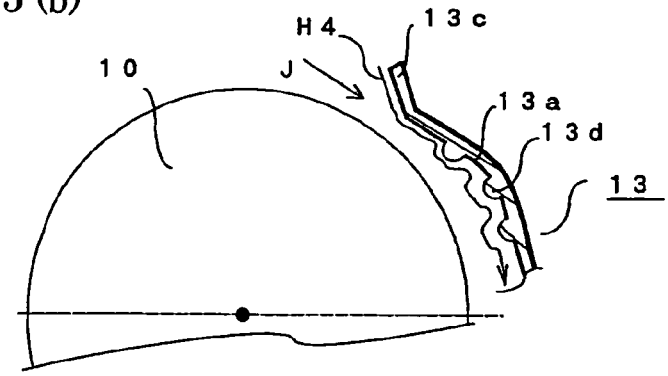

According to the embodiment, a plurality of the projections 13*b* inclined to the air flowing direction are juxtaposed, in which the concave-convex portions generating turbulences above the casing wall surface are arranged apart in the rotational axis direction E of the impeller 10. However, other examples are shown in FIGS. 13 to 15.

Figure 13:
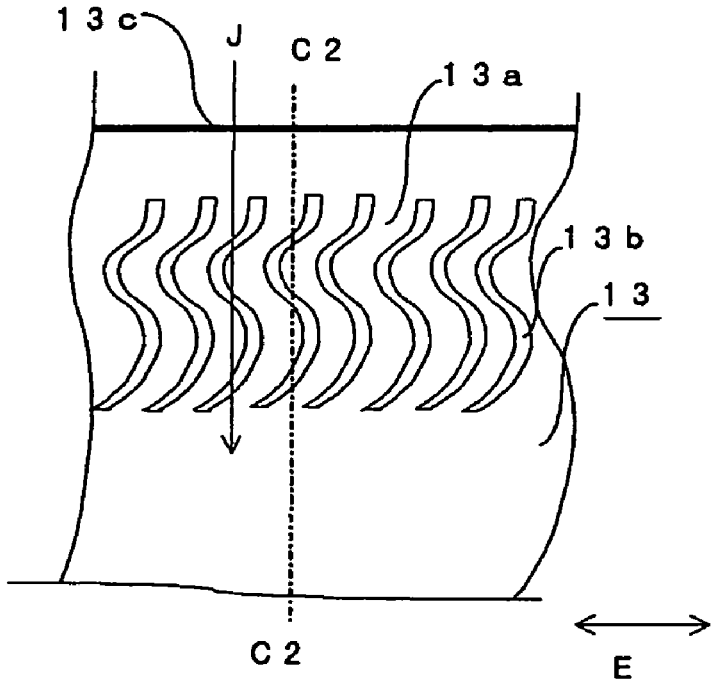
FIG. 13 is an explanatory view showing an air stream flowing in the vicinity of the casing of another example according to the second embodiment of the present invention, in which FIG. 13(*a*) is a front view of the casing and FIG. 13(*b*) is a sectional view of the casing.
Figure 13:
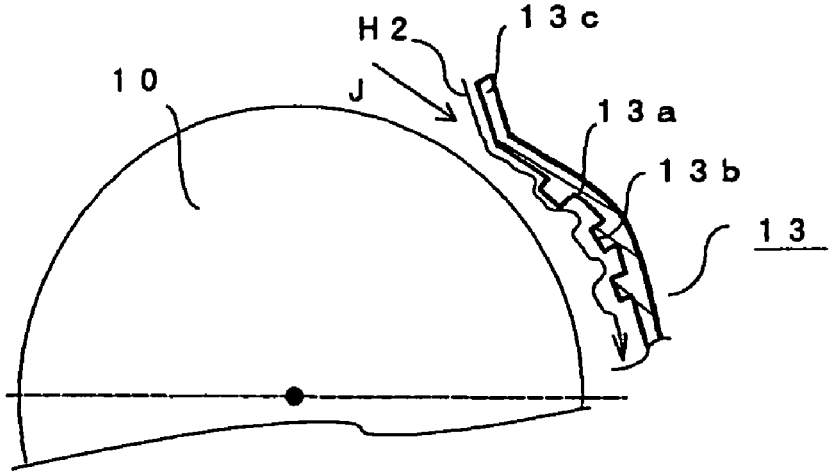

FIG. 13 shows another example of the casing 13, in which FIG. 13(*a*) is a front view of the casing 13 viewed from the surface 13*a* opposing the impeller 10, and FIG. 13(*b*) is a sectional view along the line C2-C2 of FIG. 13(*a*). Here, the shape of a plurality of the projections 13*b* formed on the casing opposing surface 13*a* is not straight but meandering.

By such projections 13*b*, a plurality of the concave-convex portions, three convex portions in FIG. 13(*b*) herein, for example, are formed on the casing opposing surface 13*a*. Hence, the air flowing along the casing opposing surface 13*a* in arrow J direction is waved, and flows while generating turbulences. That is, as shown by arrow H2 of FIG. 13(*b*), the air flows from the casing volute tongue portion 13*c*, which is a leading end on the upstream side, toward the downstream along the opposing surface 13*a* while waving up and down in a direction perpendicular to the opposing surface 13*a*.

Thus, in the same way as in the configuration shown in FIG. 12, the eddy 16 is stabilized with the turbulence and the reverse inhalation generation can be prevented. Furthermore, the concave-convex portions are arranged apart in the rotational axis direction E, so that the pressure change produced at the time when the impeller 10 passes along the casing opposing surface 13*a* is decreased, reducing wind sound. Since the projections 13*b* are arranged at least above the horizontal plane including the rotational axis of the impeller 10, the noise can be further reduced.

FIG. 14 shows still another example of the casing 13, in which FIG. 14(*a*) is a front view of the casing 13 viewed from the surface 13*a* opposing the impeller 10, and FIG. 14(*b*) is a sectional view along the line C3-C3 of FIG. 14(*a*). Here, the shape of a plurality of the projections 13*b* formed on the casing opposing surface 13*a* is aggregation of discontinuous oblique projections 13*b*.

By such projections 13*b*, a plurality of the concave-convex portions, five convex portions in FIG. 14(*b*) herein, for example, are formed on the casing opposing surface 13*a*. Hence, the air flowing along the casing opposing surface 13*a* in the arrow J direction is waved, and it flows while generating turbulences. That is, as shown by the arrow H3 of FIG. 14(*b*), the air flows from the casing volute tongue portion 13*c*, which is the leading end on the upstream side, toward the downstream along the opposing surface 13*a* while waving up and down mainly in a direction perpendicular to the opposing surface 13*a*.

Thus, in the same way as in the configuration shown in FIG. 12, the eddy 16 is stabilized with the turbulence and the reverse inhalation generation can be prevented. Furthermore, the concave-convex portions are arranged apart in the rotational axis direction E, so that the pressure change produced at the time when the impeller 10 passes along the casing opposing surface 13*a* is decreased, reducing wind sound. Since the projections 13*b* are arranged at least above the horizontal plane including the rotational axis, the noise can be further reduced.

According to this example, some air flow in the arrow J direction along portions without the concave-convex portions of the opposing surface 13*a* depending on the position in the rotational axis direction; in this case also, the air flow is influenced by the concave-convex portions in the vicinity or by the turbulence produced with the concave-convex portions, so that the same advantages as those of FIGS. 12 and 13 are obtained.

FIG. 15 shows another example of the casing 13, in which FIG. 15(*a*) is a front view of the casing 13 viewed from the surface 13*a* opposing the impeller 10, and FIG. 15(*b*) is a sectional view along the line C4-C4 of FIG. 15(*a*). Here, a plurality of spherical projections 13*d* are formed on the casing opposing surface 13*a*.

By such spherical projections 13*d*, a plurality of the concave-convex portions, three convex portions in FIG. 15(*b*) herein, for example, are formed on the casing opposing surface 13*a*. Hence, the air flowing along the casing opposing surface 13*a* in arrow J direction is waved, and it flows while generating turbulences. That is, as shown by arrow H4 of FIG. 15(*b*), the air flows from the casing volute tongue portion 13*c*, which is the leading end on the upstream side, toward the downstream along the opposing surface 13*a* while waving up and down in a direction perpendicular to the opposing surface 13*a*.

Thus, in the same way as in the configuration shown in FIG. 12, the eddy 16 is stabilized with the turbulence and the reverse inhalation generation can be prevented. Furthermore, the concave-convex portions are arranged apart in the rotational axis direction E, so that the pressure change produced at the time when the impeller 10 passes along the casing opposing surface 13*a* is decreased, reducing wind sound. Since the projections 13*b* are arranged at least above the horizontal plane including the rotational axis of the impeller 10, the noise can be further reduced.

According to this example, the produced turbulence differs in accordance with the arrangement of the spherical projections 13*d*. However, by forming at least two convex portions in the direction J, the same advantages as those of any one of FIGS. 12 to 14 are obtained.

In respective FIGS. 12 to 15, the concave-convex portions may also be formed by providing concave portions on the opposing surface 13*a* across the flowing direction J, instead of the projections 13*b*. When the concave-convex portions are arranged above the horizontal plane including the rotational axis of the impeller 10, a large turbulence is produced and the eddy 16 is further stabilized.

By shallowly inscribing the casing opposing surface 13*a* to have not a smooth surface but a corrugated surface, the air flow is also disturbed with the casing opposing surface 13*a*, so that the reverse inhalation can be prevented. When shallowly inscribing the casing opposing surface 13*a* to have a corrugated surface, the concave-convex portions are necessarily arranged apart in the rotational axis direction, so that noise is also reduced.

Third Embodiment

An indoor unit of an air conditioner according to a third embodiment of the present invention will be described. The sectional structure of the indoor unit according to the embodiment is the same as that shown in FIG. 1, and the air conditioning operation by changing air quality in a room is also the same as that according to the first embodiment, so that the descriptions are omitted.

Figure 16:
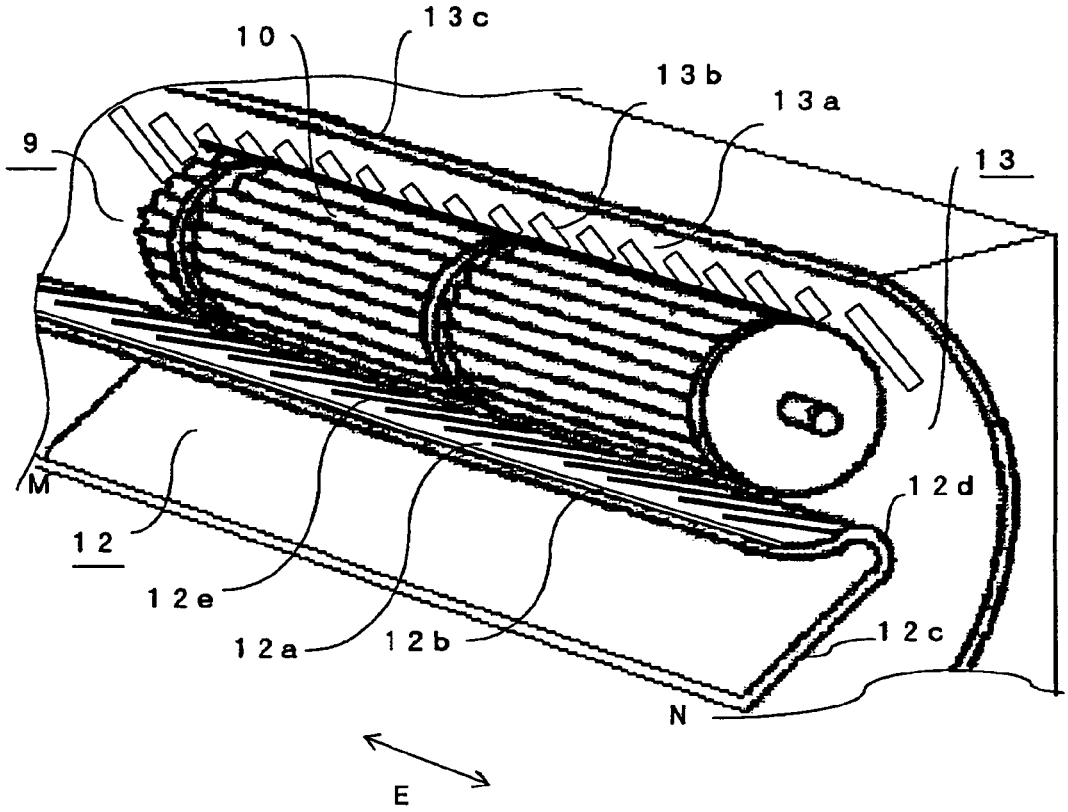
FIG. 16 is a perspective view of a fan according to a third embodiment of the present invention.
Figure 17:
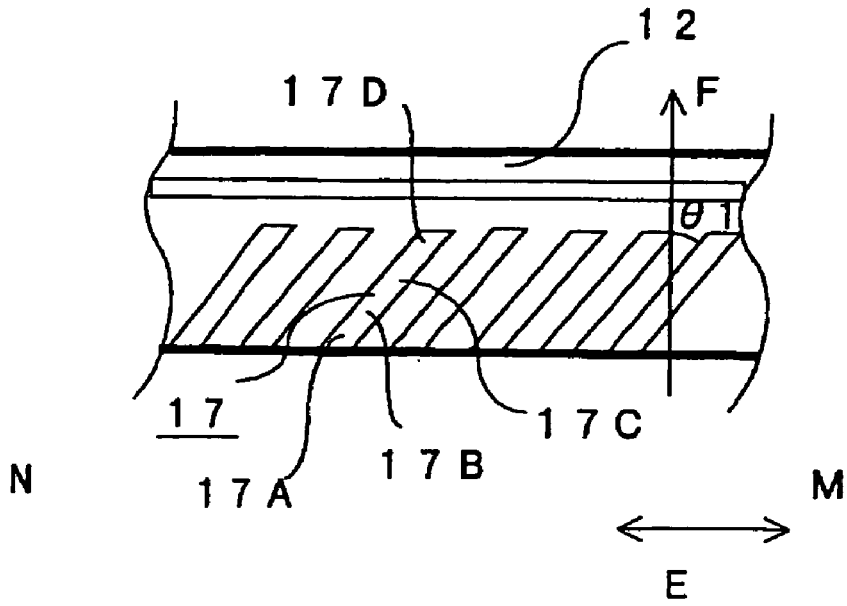
FIG. 17 is an explanatory view illustrating an operation of the fan according to the third embodiment of the present invention, in which FIG. 17(*a*) is a front view of grooves formed on the stabilizer viewed from a surface opposing the impeller and FIG. 17(*b*) is a front view of projections formed on the casing viewed from a surface opposing the impeller.
Figure 17:
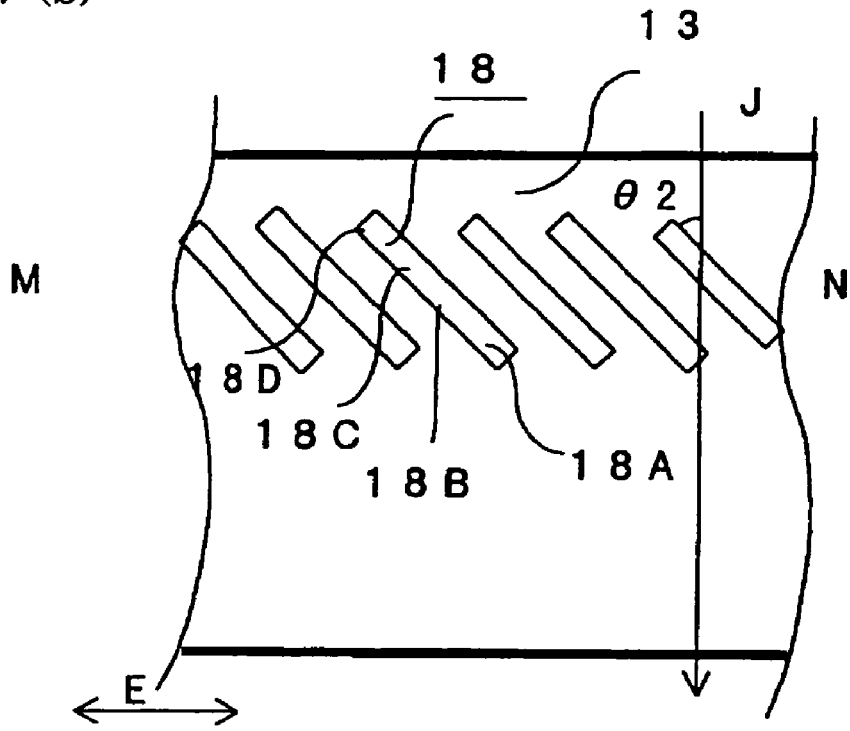

FIG. 16 is a perspective view of the cross-flow fan 9 according to the embodiment, in which like reference characters designate like components equivalent or common to FIGS. 2 and 11. FIG. 17(*a*) is a front view of the stabilizer 12 viewed from the surface 12*a* opposing the impeller 10, and FIG. 17(*b*) is a front view of the casing 13 viewed from the surface 13*a* opposing the impeller 10. The stabilizer 12 according to the embodiment, as shown in FIG. 17(*a*), has a plurality of grooves 12*e*. The detailed structure and operation/working effect with regard to the concave-convex portions of the stabilizer opposing surface 12*a* are the same as those of the first embodiment, so that the description is omitted herein. The detailed structure and operation/working effect with regard to the concave-convex portions of the casing opposing surface 13*a* are the same as those of the second embodiment, so that the description is omitted herein.

A plurality of the grooves 12*e* arranged on the stabilizer opposing surface 12*a* according to the embodiment have an angle of inclination θ1, 45° for example, to the flowing direction F of air flowing along the stabilizer opposing surface 12*a*. A plurality of the projections 13*b* arranged on the casing opposing surface 13*a* have an angle of inclination θ2, 45° for example, to the flowing direction J of air flowing along the casing opposing surface 13*a*. According to the embodiment, the inclining direction of the groove 12*e* provided in the stabilizer and the inclining direction of the projection 13*b* provided in the casing 13 are arranged so as to reduce noise.

In FIG. 16, in order to consider the position in the direction of rotational axis direction E of the impeller 10, the left end of the drawing denotes M and the right end denotes N. In also FIG. 17(*a*), (*b*), the same characters are indicated.

When the impeller 10 is rotated, the impeller 10 passes along the stabilizer opposing surface 12*a* in the direction F, and large change in pressure is produced at this time so as to generate wind noise which is the narrow band noise. Similarly, when the impeller 10 is rotated, the impeller 10 passes through the casing opposing surface 13*a* in the direction J, and large change in pressure is produced at this time so as to generate wind noise. The grooves 12*e* arranged on the stabilizer 12 have an angle of inclination θ1 to the air flowing along the opposing surface 12*a* while the projections 13*b* arranged on the casing 13 have an angle of inclination θ2 to the air flowing along the opposing surface 13*a*. That is, the position of the concave portion in the direction of the air stream formed by the grooves 12*e* and the position of the convex portion in the direction of the air stream formed by the projections 13*b* are shifted in the rotational axis direction E of the impeller 10, respectively.

In the stabilizer 12, pressure changes produced at the time when one fan body constituting the impeller 10 passes grooves 17 shown in FIG. 17(*a*) in F direction are generated in the sequential order of 17A, 17B, 17C, and 17D. At this time, the position of the vane producing the pressure change is shifted in the direction from N to M. On the other hand, on the casing 13, pressure changes produced at the time when one fan body constituting the impeller 10 passes projections 18 shown in FIG. 17(*b*) in J direction through are generated in the sequential order of 18D, 18C, 18B, and 18A. At this time, the position of the vane producing the pressure change is shifted in the direction from M to N.

In such a manner, the shifting direction of the position where one fan body produces the pressure change on the stabilizer 12 is reversed to that on the casing 13, so that the produced noise is reduced.

Figure 19:
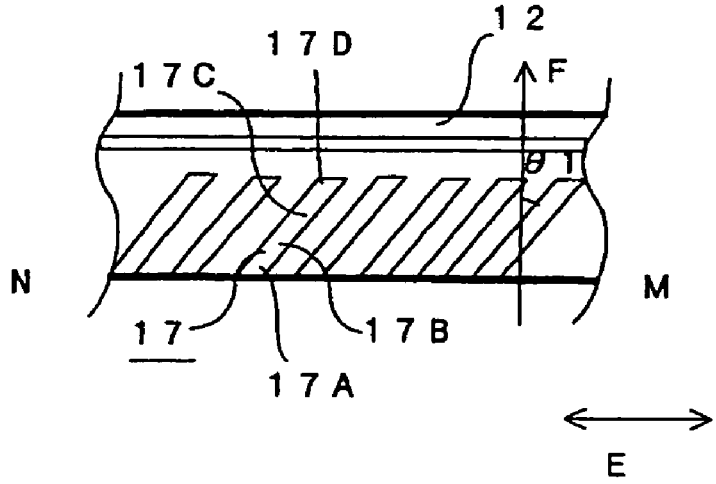
FIG. 19 is an explanatory view illustrating operations of the fan according to the third embodiment of the present invention and a comparative example of a fan, in which FIG. 19(*a*) is a front view of the grooves formed on the stabilizer viewed from the surface opposing the impeller and FIG. 19(*b*) is a front view of the projections formed on the casing viewed from the surface opposing the impeller.
Figure 19:
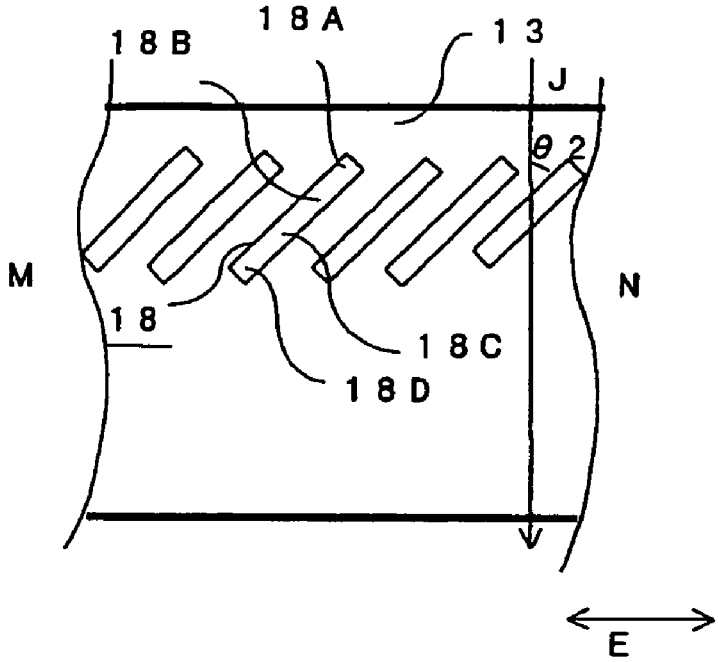

FIG. 19 illustrates the structure of a comparative example to be compared with the structure of the example shown in FIG. 17. In the stabilizer 12, pressure changes produced at the time when one fan body constituting the impeller 10 passes the grooves 17 shown in FIG. 19(*a*) in F direction are generated in the sequential order of 17A, 17B, 17C, and 17D. At this time, the position of the vane producing the pressure change is shifted in the direction from N to M. On the other hand, on the casing 13, pressure changes produced at the time when one fan body constituting the impeller 10 passes the projections 18 shown in FIG. 19(*b*) in J direction are generated in the sequential order of 18A, 18B, 18C, and 18D. At this time, the position of the vane producing the pressure change is shifted in the same direction as on the stabilizer 12, i.e., from N to M.

Figure 20:
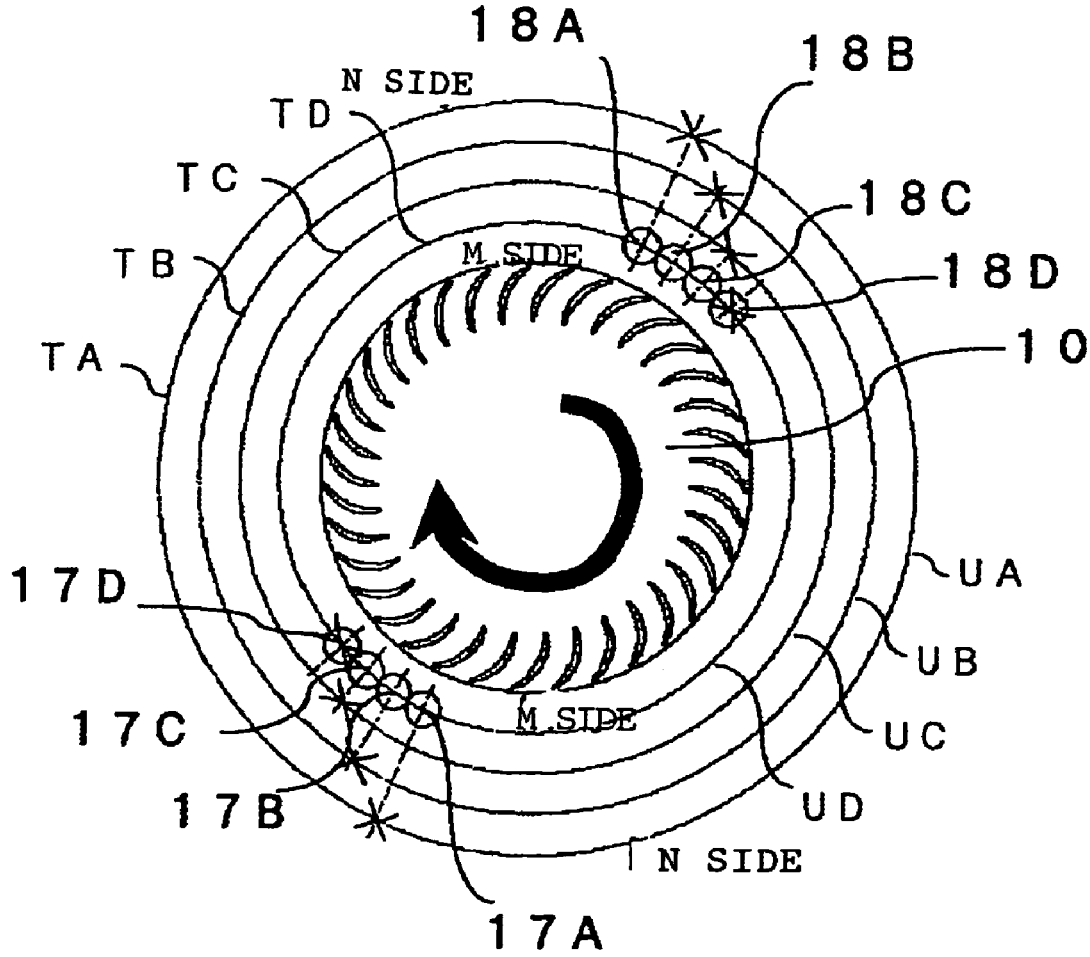
FIG. 20 is an explanatory view showing a comparative example of the relationship among the impeller, the grooves formed on the stabilizer, and the projections formed on the casing, so as to be compared with the fan according to the third embodiment of the present invention.

FIG. 20 is a schematic relational view between the pressure change producing site and the impeller. Each period of time T from the time when one fan body in the impeller 10 produces the pressure change at a pressure change producing site 17 on the stabilizer 12 to the time when it produces the pressure change at a pressure change producing site 18 on the casing 13 is indicated by TA, TB, TC, and TD. For example, the time at positions from N side to M side of the fan body sequentially corresponds to TA, TB, TC, and TD. Similarly, each period of time U from the time when one fan body in the impeller 10 produces the pressure change at the pressure change producing site 18 on the casing 13 to the time when it produces the pressure change at the pressure change producing site 17 on the stabilizer 12 is indicated by UA, UB, UC, and UD. For example, the time at positions from N side to M side of the fan body sequentially corresponds to UA, UB, UC, and UD.

As shown in FIG. 19, when the shifting direction of the position where the pressure change is produced on the stabilizer 12 is the same as on the casing 13, such as from N to M, approximately TA=TB=TC=TD and approximately UA=UB=UC=UD. If the pressure change is periodically produced in such a manner, the wind sound is emphasized, resulting in large noise especially when the air conditioner is operated at a rotation speed of about 1200 rpm.

Figure 18:
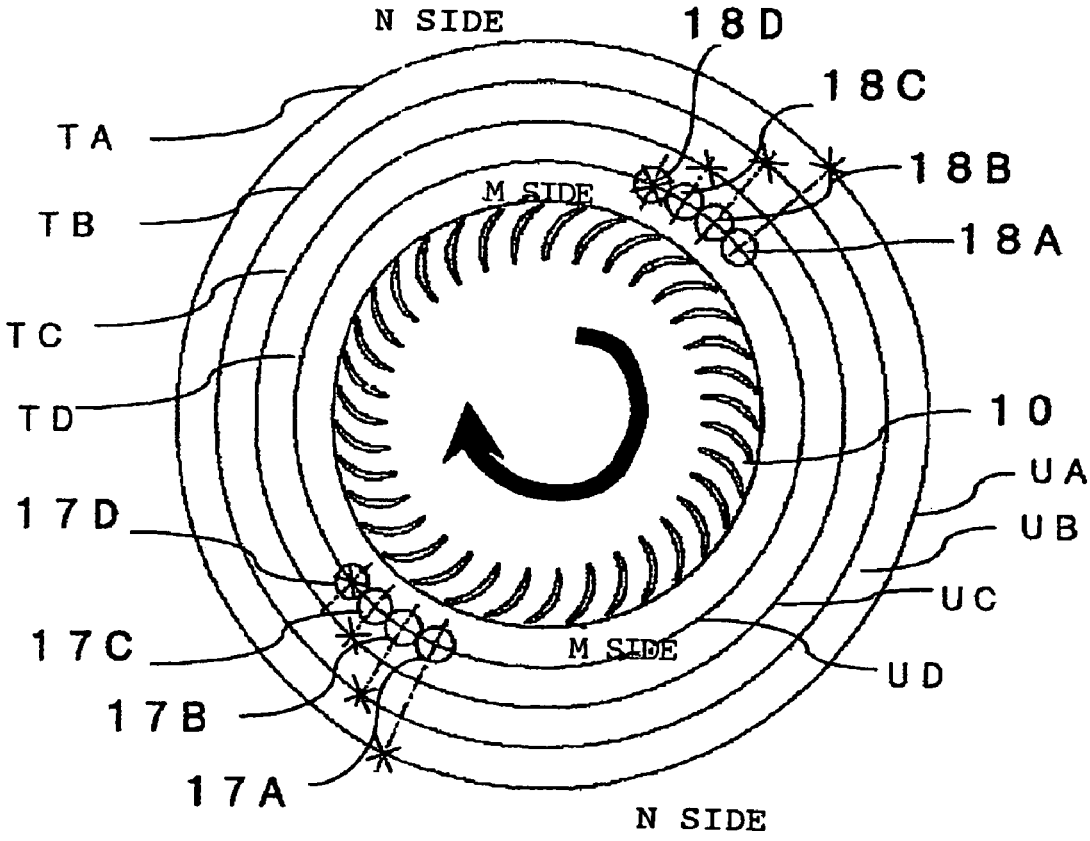
FIG. 18 is an explanatory view showing the relationship among the impeller, grooves formed on the stabilizer, and projections formed on the casing according to the third embodiment of the present invention.

Whereas, as shown in FIG. 17, the shifting direction of the position where one fan body produces the pressure change differs as to the rotational axis direction E. Hence, as shown in FIG. 18, TA>TB>TC>TD, and UD>UC>UB>UA, so that the pressure change is aperiodically produced and the wind sound is dispersed, reducing noise and improving audibility.

In FIG. 16, the embodiment has been described in that the grooves 12*e* are arranged on the stabilizer 12 while the projections 13*b* are provided on the casing 13. However, on the stabilizer 12, the grooves or the projections of the other examples shown in the first embodiment may be provided. On the casing 13, the projections of the other examples shown in the second embodiment may also be provided. Also, different from the same shape, the combination of different structures may be adopted. The time of producing the pressure change on the stabilizer opposing surface 12*a* and the casing opposing surface 13*a* may be established so that respective TA, TB, TC, TD, UA, UB, UC, and UD are different from each other, such that TA<TB<TC<TD, and UD<UC<UB<UA, for example. When the concave portions or the convex portions are formed of the dimples, the intervals may be set at random. In such manners, when the pressure change is aperiodically produced on the stabilizer opposing surface 12*a* and the casing opposing surface 13*a*, the wind sound is dispersed, reducing noise and improving audibility.

As described above, when the concave portions or the convex portions are arranged on both the stabilizer opposing surface 12*a* and the casing opposing surface 13*a* so that the positions of the concave portions or the convex portions are shifter in the rotational axis direction E, the shifting direction in the rotational axis direction E of the position where one rotating fan body passes the concave portion or the convex portion on the stabilizer opposing surface 12*a* is reversed to that on the casing opposing surface 13*a*, so that wind sound can be dispersed, reducing noise.

The cross-flow fan used for the indoor unit 1 of the air conditioner has been described herein. In a case of an air conditioner without a blowing device or a heat exchanger, dew splash is not generated even if the reverse inhalation is generated. By preventing the reverse inhalation, noise is prevented and the blowing performance is improved due to the stabilizing the cross-flow eddy. That is, the respective first to third embodiments are not limited to the cross-flow fan used for the indoor unit 1 of the air conditioner, so that the embodiments may be applied to other blowers as long as they include the impeller 10 having the blowing performance by the rotation, and an air flow path is formed by the impeller 10 in combination with the stabilizer 12 and the casing 13 which are arranged in the periphery of the impeller 10. The blowers have advantages of stable blowing performance and the reduction in broad band noise.

The impeller 10 of the cross-flow fan 9 described in the respective first to third embodiments is composed of cylindrical fan body constituted by a plurality of vanes extending in the rotational axis direction in parallel with the rotational axis. The structure of the impeller 10 is not limited to that in which the vanes of the fan bodies are arranged in parallel with the rotational axis, so that the fan bodies twisted about the rotational axis from one end toward the other end may also be adopted, for example. That is, even when at least any one of structures of the first to third embodiments is applied to the stabilizer or the casing opposing an impeller having skew vanes, the cross-flow eddy 15 or the eddy 16 can be stabilized, preventing the reverse inhalation. Incidentally, in the case when the impeller having skew vanes is incorporated, the inclination angle of the grooves or the projections provided on the stabilizer or the casing is reduced by the skew angle, so that the noise may be largely reduced.

As described above, in a blowing device, housed in the indoor unit of the air conditioner, including the heat exchanger for exchanging heat with room air, the air flow path having the inlet for guiding the room air toward the heat exchanger and the outlet, and the cross-flow fan, arranged along the air flow path, for passing the room air from the inlet to the outlet, broad band noise and wind sound are reduced and the reverse inhalation is prevented, by providing concave-convex portions producing micro turbulences on a surface of the stabilizer opposing the cross-flow fan. Thus, users may comfortably use the air conditioner.

Also, in the blowing device, housed in the indoor unit of the air conditioner, including the heat exchanger for exchanging heat with room air, the air flow path having the inlet for guiding the room air toward the heat exchanger and the outlet, and the cross-flow fan, arranged along the air flow path, for passing the room air from the inlet to the outlet, broad band noise and wind sound are reduced and the reverse inhalation is prevented, by providing grooves on a surface of the stabilizer opposing the cross-flow fan, in which the grooves have an inclination angle to the air flow direction. Thus, users may comfortably use the air conditioner.

Also, in the blowing device, housed in the indoor unit of the air conditioner including the heat exchanger for exchanging heat with room air, the air flow path having the inlet for guiding the room air toward the heat exchanger and the outlet, and the cross-flow fan, arranged along the air flow path, for passing the room air from the inlet to the outlet, broad band noise and wind sound are reduced and the reverse inhalation is prevented by providing concave-convex portions producing micro turbulences above the casing wall surface. Thus, users may comfortably use the air conditioner.

Also, in the blowing device, housed in the indoor unit of the air conditioner, including the heat exchanger for exchanging heat with room air, the air flow path having the inlet for guiding the room air toward the heat exchanger and the outlet, and the cross-flow fan, arranged along the air flow path, for passing the room air from the inlet to the outlet, broad band noise and wind sound are reduced and the reverse inhalation is prevented, by providing projections above the casing wall surface, in which the projections have an inclination angle to the air flow direction. Thus, users may comfortably use the air conditioner.

Also, in the blowing device, housed in the indoor unit of the air conditioner, including the heat exchanger for exchanging heat with room air, the air flow path having the inlet for guiding the room air toward the heat exchanger and the outlet, and the cross-flow fan, arranged along the air flow path, for passing the room air from the inlet to the outlet, broad band noise and wind sound are reduced while the reverse inhalation is prevented, by providing grooves on a surface of the stabilizer opposing the cross-flow fan, in which the grooves have an inclination angle to the air flow direction, and also by providing projections above the casing wall surface, in which the projections have an inclination angle to the air flow direction, and the angle defined by the stabilizer grooves and the casing projections ranges from 0° to 180°. Thus, users may comfortably use the air conditioner.

REFERENCE NUMERALS

1: air conditioner
4: air inlet
6: air outlet
8: heat exchanger
9: fan
10: impeller
11: inhaling flow-path
12: stabilizer
12*a:* opposing surface
12*b:* projection
12*c:* blowing off flow-path section
12*d:* leading end on the upstream side
12*e:* groove
12*f:* dimple
13: casing
13*a:* opposing surface
13*b:* projection
13*c:* volute tongue portion
13*d:* spherical projection
14: blowing off flow-path
15: cross-flow eddy
16: eddy

The invention claimed is:

1. An air conditioner comprising:

an impeller including a cylindrical fan body extending in a rotational axis direction;

a casing and a stabilizer which are arranged with the impeller therebetween for guiding a gas from an inlet to an outlet;

a projection which is arranged at an end of the stabilizer on a downstream side of a gas stream flowing along a surface of the stabilizer opposing the impeller and protrudes toward the impeller so as to define the shortest distance to the impeller; and a plurality of concave portions or convex portions are arranged on at least a leading end of the stabilizer on an upstream side of the gas stream relative to the projection and so as to disturb the gas stream flowing along the opposing surface, wherein positions of the concave portions or the convex portions are arranged apart in the rotational axis direction of the impeller.

2. The air conditioner according to claim 1, wherein the concave portions or the convex portions are arranged at least at the leading end on the upstream side of the gas stream flowing along the opposing surface.

3. The air conditioner according to claim 1, wherein the concave portions or the convex portions are formed by juxtaposing a plurality of grooves or projections extending in a direction intersecting the gas stream flowing along the opposing surface.

4. The air conditioner according to claim 3, wherein the grooves or the projections have an inclination angle in the range from 30° to 70° to the gas stream flowing along the opposing surface.

5. An air conditioner comprising:

an impeller including a cylindrical fan body extending in a rotational axis direction;

a casing and a stabilizer which are arranged with the impeller therebetween for guiding a gas from an inlet to an outlet; and a plurality of projections arranged on a surface of the casing opposing the impeller so as to disturb a gas stream flowing along the opposing surface, wherein positions of the projections are arranged apart in the rotational axis direction of the impeller and the projections are formed by juxtaposing a plurality of projections extending in a direction intersecting the gas stream flowing along the opposing surface at an inclination angle.

6. The air conditioner according to claim 5, wherein the projections are arranged at least above a horizontal plane including a rotational axis of the impeller.

7. The air conditioner according to claim 5, wherein the inclination angle is in the range from 30° to 70°.

8. The air conditioner according to claim 6, wherein the inclination angle is in the range from 30° to 70°.

9. The air conditioner according to claim 2, wherein the concave portions or the convex portions are formed by juxtaposing a plurality of grooves or projections extending in a direction intersecting the gas stream flowing along the opposing surface.

* * * * *